US005342747A

United States Patent [19]

Morigaki et al.

[11] Patent Number: 5,342,747

[45] Date of Patent: * Aug. 30, 1994

[54] SILVER HALIDE COLOR PHOTOGRAPHIC MATERIAL COMPRISING A PYRROLOTRIAZOLE CYAN COUPLER AND A SPECIFIC LIPOPHILIC COMPOUND

[75] Inventors: Masakazu Morigaki; Yasuhiro Yoshioka; Nobuo Seto, all of Kanagawa, Japan

[73] Assignee: Fuji Photo Film Co., Ltd., Kanagawa, Japan

[ * ] Notice: The portion of the term of this patent subsequent to Oct. 26, 2010 has been disclaimed.

[21] Appl. No.: 982,775

[22] Filed: Nov. 27, 1992

[30] Foreign Application Priority Data

Nov. 27, 1991 [JP] Japan ..... 3-335811

[51] Int. Cl.[5] ..... G03C 1/08; G03C 7/26; G03C 7/32

[52] U.S. Cl. ..... 430/551; 430/558; 430/384; 430/385; 430/372

[58] Field of Search ..... 430/384, 385, 558, 551, 430/372

[56] References Cited

U.S. PATENT DOCUMENTS

| | | | |
|---|---|---|---|
| 4,873,183 | 10/1989 | Tachibana et al. | 430/558 |
| 4,910,127 | 3/1990 | Sakaki et al. . | |
| 5,091,297 | 2/1992 | Fukunaga et al. | 430/384 |
| 5,164,289 | 11/1992 | Shimada et al. | 430/385 |
| 5,194,348 | 3/1993 | Morigaki et al. | 430/551 |
| 5,206,130 | 4/1993 | Shimada et al. | 430/385 |
| 5,215,871 | 6/1993 | Sato et al. | 430/385 |
| 5,256,526 | 10/1993 | Suzuki et al. | 430/385 |

FOREIGN PATENT DOCUMENTS

| | | |
|---|---|---|
| 0249453 | 12/1987 | European Pat. Off. . |
| 0488248 | 6/1992 | European Pat. Off. . |
| 0491197 | 6/1992 | European Pat. Off. . |

*Primary Examiner*—Charles L. Bowers, Jr
*Assistant Examiner*—Geraldine Letscher
*Attorney, Agent, or Firm*—Sughrue, Mion, Zinn, Macpeak & Seas

[57] ABSTRACT

Disclosed is a silver halide color photographic material comprising a support having thereon at least one silver halide emulsion layer containing a pyrrolotriazole cyan coupler and a specific lipophilic compound. The color photographic material have improved color reproducibility and preservability.

16 Claims, No Drawings

SILVER HALIDE COLOR PHOTOGRAPHIC MATERIAL COMPRISING A PYRROLOTRIAZOLE CYAN COUPLER AND A SPECIFIC LIPOPHILIC COMPOUND

FIELD OF THE INVENTION

The present invention relates to a silver halide color photographic material. More particularly, the present invention relates to a silver halide color photographic material which provides improvements in color reproducibility and preservability.

BACKGROUND OF THE INVENTION

In general, a silver halide color photographic material comprises silver halide emulsion layers sensitive to three primary colors, i.e., red, green and blue, respectively. In such a silver halide color photographic material, a color image is reproduced in the so-called subtractive process in which three couplers in these emulsion layers are developed to colors complementary to the corresponding colors to which these layers are sensitive. The color image obtained by the photographic processing of such a silver halide color photographic material normally comprises an azomethine dye or indoaniline dye produced by the reaction of an oxidation product of an aromatic primary amine color developing agent with a coupler.

In the silver halide color photographic material, a phenolic or naphtholic coupler is used to form a cyan dye image. However, since these couplers undesirablly exhibit absorption in the blue or green range, they have a great disadvantage in that they cause a remarkable drop in the color reproducibility.

As a means of solving this problem, European Patent 249,453A2 has proposed use of 2,4-diphenylimidazoles as couplers. Dyes produced from these couplers exhibit less undesirable absorption in the short wavelength range than the conventional dyes and thus are preferable in color reproduction.

However, these couplers, too, leave much to be desired in color reproducibility. These couplers also have practical problems in that they exhibit a low coupling activity and a remarkably low fastness to heat and light.

Further, pyrazoloazole cyan couplers as disclosed in U.S. Pat. No. 4,873,183 exhibit less undesirable absorption in the short wavelength range than the conventional dyes but leave much to be desired in color development and color reproducibility as cyan couplers.

In the course of studies of eliminating the abovedescribed defects, it was found that when the color-forming ability of the couplers is improved, the unexposed portion tends to be cyan-colored (so-called "cyan stain") with a passage of time after development.

Further, these couplers leave much to be desired in the recent high requirements such as color development, color reproducibility and fastness.

SUMMARY OF THE INVENTION

It is therefore an object of the present invention to provide a silver halide color photographic material having an excellent color reproducibility and an improved preservability after development.

It is another object of the present invention to provide a silver halide color photographic material which exhibits reduced cyan stain.

It is a further object of the present invention to provide a silver halide color photographic material which exhibits improved color development and fastness and reduced yellow stain on the non-image portion.

It is still a further object of the present invention to provide a silver halide color photographic material which exhibits reduced fog.

These and other objects of the present invention will become more apparent from the following detailed description and examples.

The inventors made extensive studies. As a result, it was found that these objects of the present invention are accomplished with a silver halide color photographic material comprising on a support at least one silver halide emulsion layer, wherein said at least one silver halide emulsion layer comprises at least one cyan coupler represented by formula (I) or (II), and at least one lipophilic compound represented by formula (A), (B) or (C) which chemically bonds to an aromatic primary amine color developing agent in a pH range of 8 or less to form a substantially colorless product and/or at least one lipophilic compound represented by formula (D) which chemically bonds to an oxidation product of an aromatic primary amine color developing agent in a pH range of 8 or less to form a substantially colorless product.

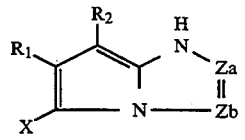

(I)

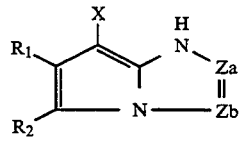

(II)

wherein Za and Zb each represents —C($R_3$)= or —N=, with the proviso that one of Za and Zb is —N= and the other is —C($R_3$)=; $R_1$ and $R_2$ each represents an electrophilic group whose Hammett's substituent constant $\sigma_p$ is 0.20 or more, with the proviso that the sum of $\sigma_p$ of $R_1$ and $R_2$ is 0.65 or more; $R_3$ represents a hydrogen atom or a substituent; X represents a hydrogen atom or a group which can be separated from the rest of the compound upon a coupling reaction with an oxidation product of an aromatic primary amine color developing agent; and $R_1$, $R_2$, $R_3$ or X may be a divalent group which is bonded to a dimer or higher polymer or high molecular chain to form a single polymer or copolymer;

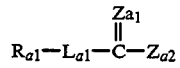

(A)

wherein $L_{a1}$ represents a single bond, —O—, —S—, —CO— or —N($R_{a2}$)—; $R_{a1}$ and $R_{a2}$ may be the same or different and each represents an aliphatic group, an aromatic group or a heterocyclic group; $R_{a2}$ also represents a hydrogen atom, an acyl group, a sulfonyl group, a carbamoyl group or a sulfamoyl group; $Z_{a1}$ represents an oxygen atom or a sulfur atom; $Z_{a2}$ represents a hydrogen atom, —O—$R_{a3}$, —S—$R_{a4}$, —$L_{a2}$—C(=$Z_{a1}$')$R_{a5}$ or a heterocyclic group bonded to the rest of the compound via a nitrogen atom; $R_3$ and $R_{a4}$ may be the same or different and each represents a vinyl group, an aromatic group or a heterocyclic group which may contain substituents; $L_{a2}$ represents —O— or —S—; $Z_{a1}'$ has the same meaning as $Z_{a1}$; $R_{a5}$ represents an aliphatic group, an aromatic group or a heterocyclic group; and at least two of $R_{a1}$, $R_{a2}$ and $Z_{a2}$ may be connected to each other to form a 5- to 7-membered ring;

$$R_{b1}—Z_{b1} \quad (B)$$

wherein $R_{b1}$ represents an aliphatic group; and $Z_{b1}$ represents a halogen atom;

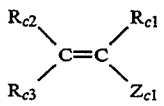

(C)

wherein $Z_{c1}$ represents a cyano group, an acyl group, a formyl group, an aliphatic oxycarbonyl group, an aromatic oxycarbonyl group, a carbamoyl group, a sulfamoyl group or a sulfonyl group; $R_{c1}$, $R_{c2}$ and $R_{c3}$ may be the same or different and each represents a hydrogen atom, an aliphatic group, an aromatic group, a heterocyclic group or $Z_{c1}$; and at least two of $R_{c1}$, $R_{c2}$, $R_{c3}$ and $Z_{c1}$ may be connected to each other to form a 5- to 7-membered ring;

$$R_{d1}—Z_{d1} \quad (D)$$

wherein $R_{d1}$ represents an aliphatic group or an aromatic group; $Z_{d1}$ represents a mercapto group or —$SO_2Y$; and Y represents a hydrogen atom, or an atom or atom group which forms an inorganic or organic salt, —NHN=C($R_{d2}$)$R_{d3}$, —N($R_{d4}$)—N($R_{d5}$)—$SO_2R_{d6}$, —N($R_{d7}$)—N($R_{d5}$)—$COR_{d9}$ or —C($R_{d10}$)($OR_{d11}$)—$COR_{d12}$ in which $R_{d2}$ and $R_{d3}$ may be the same or different and each represents a hydrogen atom, an aliphatic group, an aromatic group or a heterocyclic group, $R_{d2}$ and $R_{d3}$ may be connected to each other to form a 5- to 7-membered ring, $R_{d4}$, $R_{d5}$, $R_{d7}$ and $R_{d8}$ may be the same or different and each represents a hydrogen atom, an aliphatic group, an aromatic group, a heterocyclic group, an acyl group, an aliphatic oxycarbonyl group, a sulfonyl group, a ureide group or a urethane group, with the proviso that at least one of $R_{d4}$ and $R_{d5}$ and at least one of $R_{d7}$ and $R_{a8}$ are hydrogen atoms, $R_{d6}$ and $R_{d9}$ each represents a hydrogen atom, an aliphatic group, an aromatic group or a heterocyclic group, $R_{d6}$ also represents an aliphatic amino group, an aromatic amino group, an aliphatic oxy group, an aromatic oxy group, an acyl group, an aliphatic oxycarbonyl group or an aromatic oxycarbonyl group, at least two of $R_{d4}$, $R_{d5}$ and $R_{d6}$ may be connected to each other to form a 5- to 7-membered ring, at least two of $R_{d7}$, $R_{d8}$ and $R_{d9}$ may be connected to each other to form a 5- to 7-membered ring, $R_{d10}$ represents a hydrogen atom, an aliphatic group, an aromatic group, a halogen atom, an acyloxy group or a sulfonyl group, $R_{d11}$ represents a hydrogen atom or a hydrolyzable group, and $R_{d12}$ represents a hydrogen atom, an aliphatic group, an aromatic group or a heterocyclic group.

DETAILED DESCRIPTION OF THE INVENTION

The present invention will be further described hereinafter.

Some explanation will now be given to Hammett's substituent constant $\sigma_p$ as used herein.

Hammett's rule is an empirical rule which was proposed by L. P. Hammett in 1935 to quantitatively discuss the effects of substituents on the reaction or equilibrium of benzene derivatives. This rule is now widely regarded as appropriate. Substituent constants determined by Hammett's rule include $\sigma_p$ value and $\sigma$m value. These values can be found in many references. For example, J. A. Dean, "Lange's Handbook of Chemistry", 12th ed., 1979, McGraw-Hill, and "Kagaku no Ryoiki (Domain of Chemistry)", additional issue, No. 122, pp. 96–103, 1979, Nankodo, detail these substituent constants. In the present invention, each substituent is defined or explained by Hammett's substituent constant $\sigma$p. However, this does not mean that each substituent is limited to those having known values found in these references. It goes without saying that there are included substituents whose substituent constant will fall within the above specified range as routinely determined on the basis of Hammett's rule even if their substituent constant values are unknown in these references.

The compound of the present invention represented by the general formula (I) or (II) is not a benzene derivative. However, the $\sigma_p$ value will be used herein as a measure of the indication of the electronic effect of substituents regardless of the substitution position. The $\sigma_p$ value will be so defined hereinafter.

The term "lipophilic compound" as used herein means a "compound having a water solubility of 10 % or less at room temperature".

The term "aliphatic" as used herein means a straight-chain, branched or cyclic, saturated or unsaturated group generally having up to 70 carbon atoms, preferably up to 50 carbon atoms and more preferably up to 20 carbon atoms, such as alkyl, alkenyl, alkinyl, cycloalkyl or cycloalkenyl which may be substituted.

The term "aromatic" as used herein means aryl group generally having 6 to 76 carbon atoms, preferably 6 to 50 carbon atoms and more preferably 6 to 30 carbon atoms, which may be substituted.

The term "heterocyclic" as used herein refers to a ring having at least one hetero-atom as a member of the ring and includes an aromatic groups. The heterocyclic ring generally has 0 to 70 carbon atoms, preferably 0 to 50 carbon atoms and more preferably 0 to 30 carbon atoms, which may be substituted.

The term "substituent group" where an aliphatic group, an aromatic group or a heterocyclic ring may be substituted means any group which can be attached as a substituent group to the aliphatic group, the aromatic group or the heterocyclic ring unless otherwise indicated. Examples of the substituent group include an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxyl group, a cyano group, a nitro group, a hydroxy amino group and a halogen atom.

Further, unless otherwise defined, carbon-containing groups described herein preferably have 0 to 70 carbon atoms, more preferably up to 50 carbon atoms in total (including the carbon atoms of a substituent if any).

The cyan coupler of the present-invention will be further described hereinafter.

Za and Zb each represents —C($R_3$)= or —N=, with the proviso that one of Za and Zb is —N= and the other is —C($R_3$)=.

That is, the cyan coupler of the present invention is represented by the general formula (I-a), (I-b), (II-a) or (II-b):

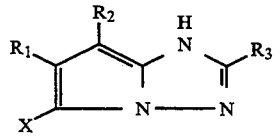
(I-a)

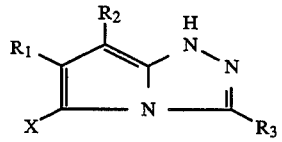
(I-b)

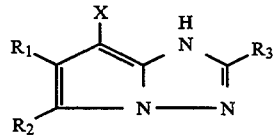
(II-a)

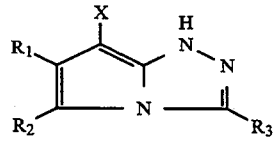
(II-b)

wherein $R_1$, $R_2$, $R_3$ and X are as defined in the general formulae (I) and (II).

$R_3$ represents a hydrogen atom or a substituent. Examples of such a substituent include a halogen atom, alkyl group, aryl group, heterocyclic group, cyano group, hydroxyl group, nitro group, carboxyl group, sulfo group, amino group, alkoxy group, aryloxy group, acylamino group, alkylamino group, anilino group, ureide group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, azo group, acyloxy group, carbamoyloxy group, silyloxy group, aryloxycarbonylamino group, imide group, heterocyclic thio group, sulfinyl group, phosphonyl group, aryloxycarbonyl group, acyl group, and azolyl group. These groups may be further substituted by substituents as exemplified with reference to $R_3$.

In more detail, $R_3$ represents a hydrogen atom, halogen atom (e.g., chlorine, bromine), aliphatic group preferably having up to 32 carbon atoms, which may be linear or branched and saturated or unsaturated, for example, alkyl group, aralkyl group, alkenyl group, alkinyl group, cycloalkyl group and cycloalkenyl group, with the alkyl group being preferred (e.g., methyl, ethyl, propyl, isopropyl, t-butyl, tridecyl, 2-methanesulfonylethyl, 3-(3-pentadecylphenoxy)propyl, 3-{4-{2-[4-(4-hydroxy-phenylsulfonyl)phenoxy]-dodecanamide}phenyl}propyl, 2-ethoxytridecyl, trifluoromethyl, cyclopentyl, 3-(2,4-di-t-amylphenoxy)propyl), aryl group preferably having 6 to 50 carbon atoms (e.g., phenyl, 4-t-butylphenyl, 2,4-di-t-amylphenyl, 4-tetradecanamidephenyl), heterocyclic group preferably having 1 to 50 carbon atoms (e.g., 2-furyl, 2-phenyl, 2-pyrimidinyl, 2-benzothiazolyl), cyano group, hydroxyl group, nitro group, carboxyl group, sulfo group, amino group, alkoxy group preferably having 1 to 50 carbon atoms (e.g., methoxy, ethoxy, 2-methoxyethoxy, 2-dodecyloxyethoxy, 2-methanesulfonylethoxy), aryloxy group preferably having 1 to 50 carbon atoms (e.g., phenoxy, 2-methylphenoxy, 4-t-butylphenoxy, 3-nitrophenoxy, 3-t-butyloxycarbamoylphenoxy, 3-methoxycarbamoylphenoxy), acylamino group preferably having 2 to 50 carbon atoms (e.g., acetamide, benzamide, tetradecanamide, 2-(2,4-di-t-amylphenoxy)butanamide, 4-(3-t-butyl-4-hydroxyphenoxy)butanamide, 2-{4-(4-hydroxyphenylsulfonyl)phenoxy}decanamide), alkylamino group preferably having 1 to 50 carbon atoms (e.g., methylamino, butylamino, dodecylamino, diethylamino, methylbutylamino), anilino group preferably having 6 to 50 carbon atoms (e.g., phenylamino, 2-chloroanilino, 2-chloro-5-tetradecanaminoanilino, 2-chloro-5-dodecyloxycarbonylanilino, N-acetylanilino, 2-chloro-5-{2-(3-t-butyl-4-hydroxyphenoxy)-dodecanamide}anilino), ureide group preferably having 2 to 50 carbon atoms (e.g., phenylureide, methylureide, N,N-dibutylureide), sulfamoylamino group preferably having 1 to 50 carbon atoms (e.g., N,N-dipropylsulfamoylamino, N-methyl—N-decylsulfamoylamino), alkylthio group preferably having 1 to 50 carbon atoms (e.g., methylthio, octylthio, tetradecylthio, 2-phenoxyethylthio, 3-phenoxypropylthio, 3-(4-t-butylphenoxy)-propylthio), arylthio group preferably having 6 to 50 carbon atoms (e.g., phenylthio, 2-butoxy-5-t-octylphenylthio, 3-pentadecylphenylthio, 2-carboxyphenylthio, 4-tetradecanamidephenylthio), alkoxycarbonylamino group preferably having 2 to 50 carbon atoms (e.g., methoxycarbonylamino, tetradecyloxycarbonylamino), sulfonamide group preferably having 1 to 50 carbon atoms (e.g., methanesulfonamide, hexadecanesulfonamide, benzenesulfonamide, p-toluenesulfonamide, octadecanesulfonamide, 2-methoxy-5-t-butylbenzenesulfonamide), carbamoyl group preferably having 1 to 50 carbon atoms (e.g., N-ethylcarbamoyl, N,N-dibutylcarbamoyl, N-(2-dodecyloxyethyl)carbamoyl, N-methyl—N-dodecylcarbamoyl, N-{3-(2,4-di-t-amylphenoxy)-propyl}carbamoyl), sulfamoyl group preferably having 0 to 50 carbon atoms (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), sulfonyl group preferably having 1 to 50 carbon atoms (e.g., methanesulfonyl, octanesulfonyl, benzenesulfonyl, toluenesulfonyl), alkoxycarbonyl group preferably having 2 to 50 carbon atoms (e.g., methoxycarbonyl, butyloxycarbonyl, dodecyloxycarbonyl, octadecyloxycarbonyl), heterocyclic oxy group preferably having 1 to 50 carbon atoms (e.g., 1-phenyltetrazole-5-oxy, 2-tetrahydropyranyloxy), azo group preferably having 6 to 50 carbon atoms (e.g., phenylazo, 4-methoxyphenylazo, 4-pivaloylaminophenylazo, 2-hydroxy-4-propanoylphenylazo), acyloxy group preferably having 2 to 50 carbon atoms (e.g., acetoxy), carbamoyloxy group preferably having 2 to 50 carbon atoms (e.g., N-methylcarbamoyloxy, N-phenylcarbamoyloxy), silyloxy group preferably having 3 to 50 carbon atoms (e.g., trimethylsilyloxy, dibutylmethylsilyloxy), aryloxycarbonylamino group preferably having 7 to 50 carbon atoms (e.g., phenoxycarbonylamino), imide group preferably having 1 to 40 carbon atoms (e.g., N-succinimide, N-phthalimide, 3-octadecenylsuccinimide), heterocyclic thio group preferably having 1 to 50 carbon atoms (e.g., 2-benzothiazolylthio, 2,4-di-phenoxy-l,3,5-triazole-6-thio, 2-pyridylthio), sulfinyl group preferably having 1 to 50 carbon atoms (e.g., dodecanesulfinyl, 3-pentadecylphenylsulfinyl, 3-phenoxypropylsulfinyl), phosphonyl group preferably having 1 to 50 carbon atoms (e.g., phenoxyphosphonyl, octyloxyphosphonyl, phenylphosphonyl), aryloxycarbonyl group preferably having 7 to 50 carbon atoms (e.g., phenoxycarbonyl), acyl group preferably having 2 to 50 carbon atoms (e.g., acetyl, 3-phenylpropanoyl, benzoyl, 4-dodecyloxybenzoyl) or azolyl group preferably having 1 to 50 carbon atoms (e.g., imidazolyl, pyrazolyl, 3-chloro-pyrazole-1-il, triazolyl).

Preferred among the groups represented by $R_3$ are alkyl group, aryl group, heterocyclic group, cyano group, nitro group, acylamino group, anilino group, ureide group, sulfamoylamino group, alkylthio group, arylthio group, alkoxycarbonylamino group, sulfonamide group, carbamoyl group, sulfamoyl group, sulfonyl group, alkoxycarbonyl group, heterocyclic oxy group, acyloxy group, carbamoyloxy group, aryloxycarbonylamino group, imide group, heterocyclic thio group, sulfinyl group, phosphonyl group, aryloxycarbonyl group, acyl group, and azolyl group.

Further preferred among these groups are an alkyl group and aryl group, more preferably an alkyl or aryl group containing at least one substituent for cohesiveness, further preferably an alkyl or aryl group containing as substituents at least one alkoxy group, sulfonyl group, sulfamoyl group, carbamoyl group, acylamide group or sulfonamide group, particularly preferably an alkyl oraryl group containing as substituents at least one acylamide group or sulfonamide group. In the aryl group, these substituents preferably substitute the hydrogen atom in the ortho position.

The cyan coupler of the present invention can be developed to a cyan dye by having a structure such that $R_1$ and $R_2$ each is an electrophilic group having a $\sigma_p$ value of 0.20 or more and the sum of $\sigma_p$ value of $R_1$ and $R_2$ is 0.65 or more.

$R_1$ and $R_2$ each is preferably an electrophilic group having a $\sigma_p$ value of 0.30 or more. The upper limit of the $\sigma_p$ value of the electrophilic group is preferably 1.0.

The sum of the $\sigma_p$ value of $R_1$ and $R_2$ is preferably 0.70 or more. The upper limit of the sum of the $\sigma_p$ value of $R_1$ and $R_2$ is about 1.8.

Specific examples of $R_1$ or $R_2$ as an electrophilic group having a $\sigma_p$ value of 0.20 or more include an acyl group, acyloxy group, carbamoyl group, alkoxycarbonyl group, aryloxycarbonyl group, cyano group, nitro group, dialkylphosphono group, diarylphosphono group, diarylphosphinyl group, alkylsulfinyl group, arylsulfinyl group, alkylsulfonyl group, arylsulfonyl group, sulfonyloxy group, acylthio group, sulfamoyl group, thiocyanate group, thiocarbonyl group, halogenated alkyl group, halogenated alkoxy group, halogenated aryloxy group, halogenated alkylamino group, halogenated alkylthio group, aryl group substituted by other electrophilic groups having a $\sigma_p$ value of 0.20 or more, heterocyclic group, halogen atom, azo group, and selenocyanate group. Among these substituents, those which can further contain substituents may further contain substituents described with reference to $R_3$.

Referring further to $R_1$ and $R_2$, specific examples of the electrophilic group having a $\sigma_p$ value of 0.20 or more include an acyl group preferably having 1 to 50 carbon atoms (e.g., acetyl, 3-phenylpropanoyl, benzoyl, 4-dodecyloxybenzoyl), acyloxy group preferably having 1 to 50 carbon atoms (e.g., acetoxy), carbamoyl group preferably having 0 to 50 carbon atoms (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamide-phenyl)carbamoyl, N-methyl—N-dodecylcarbamoyl, N-{3-(2,4-di-t-amylphenoxy)propyl}carbamoyl), alkoxycarbonyl group preferably having a straight chain, branched or cyclic alkyl moiety of 1 to 50 carbon atoms (e.g., methoxycarbonyl, ethoxycarbonyl, isopropyloxycarbonyl, tert-butyloxycarbonyl, isobutyloxycarbonyl, butyloxycarbonyl, dodecyloxycarbonyl, octadecyloxycarbonyl), aryloxycarbonyl group preferably having 6 to 50 carbon atoms (e.g., phenoxycarbonyl), cyano group, nitro group, dialkylphosphono group preferably having 2 to 50 carbon atoms (e.g., dimethylphosphono), diarylphosphono group preferably having 12 to 50 carbon atoms (e.g., diphenylphosphono), diarylphosphinyl group preferably having 12 to 50carbon atoms (e.g., diphenylphosphinyl), alkylsulfinyl group preferably having 1 to 50 carbon atoms (e.g., 3-phenoxypropylsulfinyl), arylsulfinyl group preferably having 6 to 50 carbon atoms (e.g., 3-pentadecylphenylsulfinyl), alkylsulfonyl group preferably having 1 to 50 carbon atoms (e.g., methanesulfonyl, octanesulfonyl), arylsulfonyl group preferably having 6 to 50 carbon atoms (e.g., benzenesulfonyl, toluenesulfonyl), sulfonyloxy group preferably having 1 to 50 carbon atoms (e.g., methanesulfonyloxy, toluenesulfonyloxy), acylthio group preferably having 1 to 50 carbon atoms (e.g., acetylthio, benzoylthio), sulfamoyl group preferably having 0 to 50 carbon atoms (e.g., N-ethylsulfamoyl, N,N-dipropylsulfamoyl, N-(2-dodecyloxyethyl)sulfamoyl, N-ethyl—N-dodecylsulfamoyl, N,N-diethylsulfamoyl), thiocyanate group, thiocarbonyl group preferably having 1 to 50 carbon atoms (e.g., methylthiocarbonyl, phenylthiocarbonyl), halogenated alkyl group preferably having 1 to 10 carbon atoms (e.g., trifluoromethane, heptafluoropropane), halogenated alkoxy group preferably having 1 to 10 carbon atoms (e.g., trifluoromethyloxy), halogenated aryloky group (e.g., pentafluorophenyloxy), halogenated alkylamino group (e.g., N,N-di-(trifluoromethyl-)amino), halogenated alkylthio group (e.g., difluoromethylthio, 1,1,2,2-tetrafluoroethylthio), aryl group substituted by other electrophilic groups having a $\sigma_p$ value of 0.20 or more (e.g., 2,4-dinitrophenyl, 2,4,6-trichlorophenyl, pentachlorophenyl), heterocyclic group (e.g., 2-benzoxazolyl, 2-benzothiazolyl, 1-phenyl-2-benzimidazolyl, 5-chloro-1-tetrazolyl, 1-pyrrolyl), halogen atom (e.g., chlorine, bromine), azo group (e.g., phenylazo), and selenocyanate group. Among these substituents, those which can further contain substituents may further contain substituents described with reference to $R_3$.

Preferred among the groups represented by $R_1$ or $R_2$ are an acyl group, acyloxy group, carbamoyl group, alkoxycarbonyl group, aryloxycarbonyl group, cyano group, nitro group, alkylsulfinyl group, arylsulfinyl group, alkylsulfonyl group, arylsulfonyl group, sulfamoyl group, halogenated alkyl group, halogenated alkyloxy group, halogenated alkylthio group, halogenated aryloxy group, aryl group substituted by two or more other electrophilic groups having a $\sigma_p$ value of 0.20 or more, and a heterocyclic group. More preferred among these groups are an alkoxycarbonyl group, nitro group, cyano group, arylsulfonyl group, carbamoyl group, halogenated alkyl group, and aryloxycarbonyl group.

$R_1$ is most preferably a cyano group. $R_2$ is particularly preferably alkoxycarbonyl group or aryloxycarbonyl group, most preferably branched alkoxycarbonyl group.

X represents a hydrogen atom or a group which can be eliminated from the rest of the compound upon a coupling reaction with an oxidation product of an aromatic primary amine color developing agent. Examples of such a group include a halogen atom, alkoxy group, aryloxy group, acyloxy group, alkylsulfonyloxy group, arylsulfonyloxy group, acylamino group, alkylsulfonamide group, arylsulfonamide group, alkoxycarbonyloxy group, aryloxycarbonyloxy group, alkylthio group, arylthio group, heterocyclic thio group, carbamoylamino group, 5- or 6-membered nitrogen-containing heterocyclic group, imide group, and arylazo group. These groups may be further substituted by the groups described with reference to $R_3$.

Specific examples of these eliminatable groups include a halogen atom (e.g., fluorine, chlorine, bromine), alkoxy group preferably having 1 to 50 carbon atoms (e.g., ethoxy, dodecyloxy, methoxyethylcarbamoylmethoxy, carboxypropyloxy, methanesulfonylethoxy, ethoxycarbonylmethoxy), aryloxy group preferably having 6 to 50 carbon atoms (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), acyloxy group (e.g., acetoxy, tetradecanoyloxy, benzoyloxy), alkyl- or arylsulfonyloxy group preferably having 1 to 50 carbon atoms (e.g., methanesulfonyloxy, toluenesulfonyloxy), acylamino group preferably having 2 to 50 carbon atoms (e.g., dichloroacetylamino, heptafluorobutyrylamino), alkyl- or arylsulfonamide group preferably having 1 to 50 carbon atoms (e.g., methanesulfonamide, trifluoromethanesulfonamide, p-toluenesulfonamide), alkoxycarbonyloxy group preferably having 2 to 50 carbon atoms (e.g., ethoxycarbonyloxy, benzyloxycarbonyloxy), aryloxycarbonyloxy group preferably having 7 to 50 carbon atoms (e.g., phenoxycarbonyloxy), alkylthio, arylthio or heterocyclic thio group preferably having 1 to 50 carbon atoms (e.g., dodecylthio, 1-carboxydodecylthio, phenylthio, 2-butoxy-5-t-octylphenylthio, tetrazolylthio), carbamoylamino group preferably having 2 to 50 carbon atoms (e.g., N-methylcarbamoylamino, N-phenylcarbamoylamino), 5- or 6-membered nitrogen-containing heterocyclic group preferably having 1 to 50 carbon atoms (e.g., imidazolyl, pyrazolyl, triazolyl, tetrazolyl, 1,2-dihydro-2-oxo-l-pyridyl), imide group preferably having 1 to 50 carbon atoms (e.g., succimide, hydantoinyl), and arylazo group preferably having 6 to 40 carbon atoms (e.g., phenylazo, 4-methoxyphenylazo). X may also be in the form of a bis type coupler obtained by the condensation of a four-equivalent coupler with an aldehyde or ketone as a eliminatable group to be bonded thereto via a carbon atom. Further, X may contain photographically useful groups such as a development inhibitor and a development accelerator.

Preferred among the groups represented by X are halogen atom, alkoxy group, aryloxy group, alkylthio group, arylthio group, and 5- or 6-membered nitrogen-containing heterocyclic group which is connected to the coupling position via a nitrogen atom, more preferably a halogen atom, alkylthio group and arylthio group, particularly preferably an arylthio group.

In the cyan coupler represented by the general formula (I) or (II), $R_1$, $R_2$, $R_3$ or X may be a divalent group which is connected to a dimer or higher polymer or high molecular chain to form a single polymer or copolymer. A typical example of such a single polymer or copolymer obtained by the connection of $R_1$, $R_2$, $R_3$ or X to a high molecular chain is a single polymer or copolymer of an addition polymer of an ethytenically unsaturated compound containing a cyan coupler residue represented by the general formula (I) or (II). In this case, one or more cyan color repeating units containing a cyan coupler residue represented by the general formula (I) or (II) may be present in the polymer. A copolymer containing one or more non-coloring ethylenic monomers as copolymeric components may be used. The cyan color repeating units containing a cyan coupler residue represented by the general formula (I) or (II) is preferably represented by the general formula (P):

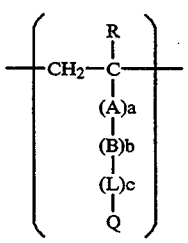

(P)

wherein R represents a hydrogen atom, $C_{1-4}$ alkyl group or chlorine atom; A represents —CONH—, —COO— or a substituted or unsubstituted phenylene group; B represents a substituted or unsubstituted alkylene, phenylene or aralkyl group; L represents —CONH—, —NHCONH—, —NHCOO—, —NHCO—, —OCONH—, —NH, —COO—, —OCO—, —CO—, —O—, —S—, —$SO_2$—, —$NHSO_2$— or —$SO_2NH$—; a, b and c each represents 0 or 1; and Q represents a cyan coupler residue produced by the separation of hydrogen atoms from $R_1$, $R_2$, $R_3$ or X in the compound represented by the general formulae (I) or (II).

As the above mentioned polymer there can be preferably used a copolymer of a cyan color monomer represented by the general formulae (I) or (II) as the coupler unit and a non-coloring ethylenic monomer which does not undergo coupling with an oxidation product of an aromatic primary amine developing agent.

Examples of the non-coloring ethylenic monomer which does not undergo reaction with an oxidation product of an aromatic primary amine developing agent include acrylic acid, α-chloroacrylic acid, α-alkylacrylic acid (e.g., methacrylic acid), amides or esters derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate), vinyl ester (e.g., vinyl acetate, vinyl propionate, vinyl laurate), acrylonitrile, methacrylonitrile, aromatic vinyl compound (e.g., styrene and derivatives thereof such as vinyl toluene, divinyl benzene, vinyl acetophenone, sulfostyrene), itaconic acid, citraconic acid, crotonic acid, vinylidene chloride, vinyl alkyl ether (e.g., vinyl ethyl ether), ester maleate, N-vinyl-2-pyrrolidone, N-vinylpyridine, and 2- and- 4-vinylpyridine.

In particular, ester acrylate, ester methacrylate and ester maleate are preferred. Two or more of these non-coloring ethylenic monomers can be used in combination. For example, methyl acrylate and butyl acrylate, butyl acrylate and styrene, butyl methacrylate and methacrylic acid, methyl acrylate and diacetone acrylamide, etc. can be used.

As is well known in the field of polymer couplers, the ethylenically unsaturated monomer to be copolymerized with the vinyl monomer corresponding to the general formula (I) or (II) may be selected such that it has a good effect on the physical and/or chemical properties such as solubility, compatibility with a photographic colloid composition binder such as gelatin, flexibility and thermal stability, of the copolymer to be formed.

In order to incorporate the cyan coupler of the present invention in a silver halide photographic material, preferably a red-sensitive silver halide emulsion layer, it is preferably in the form of a so-called coupler-in-emulsion type coupler. To this end, at least one of $R_1$, $R_2$, $R_3$ and X is preferably a so-called ballast group preferably containing 10 or more carbon atoms, more preferably 10 to 50 carbon atoms. In particular, $R_3$ is preferably a ballast group.

In the present invention, the cyan coupler represented by the general formula (I) is preferred in the light of color forming ability. In-particular, the cyan coupler represented by the general formula (I-a) is preferred.

Specific examples of the couplers of the present invention will be given below, but the present invention should not be construed as being limited thereto. (1)

(1)

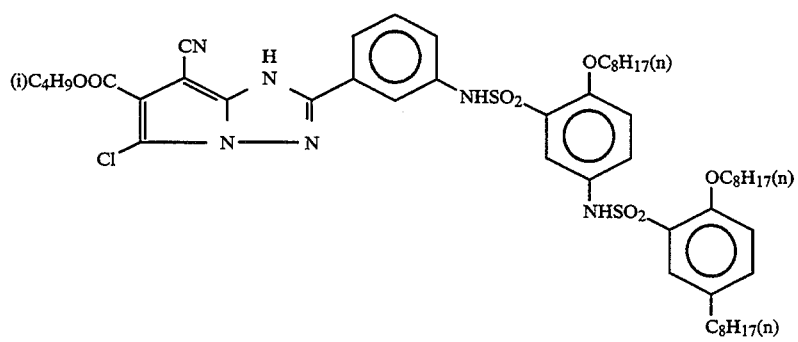

(2)

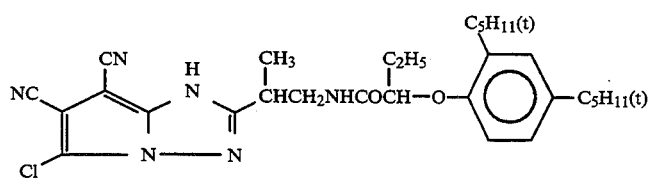

(3)

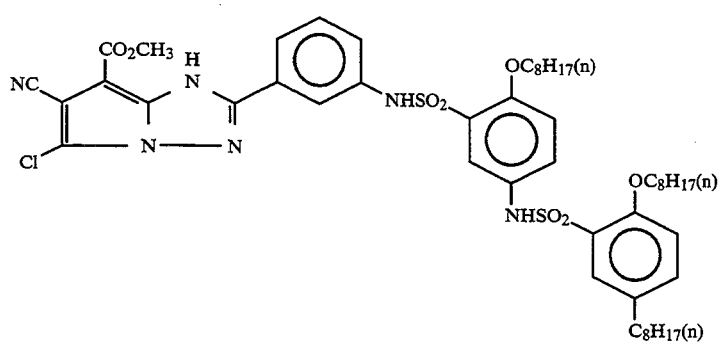

(4)

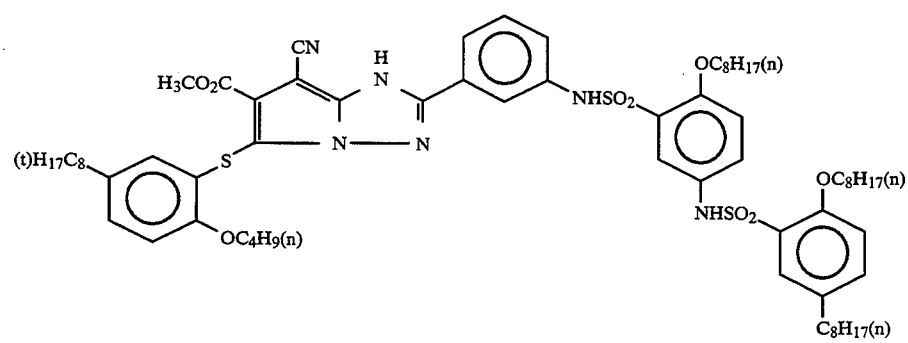

-continued
(5)
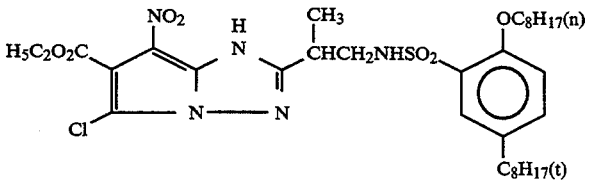
(6)
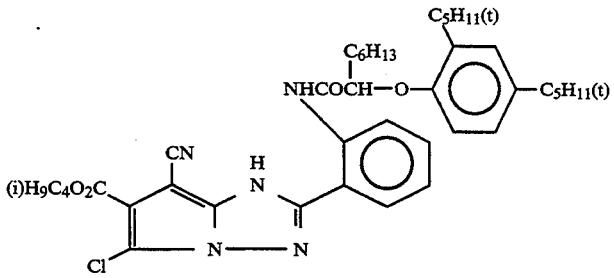
(7)
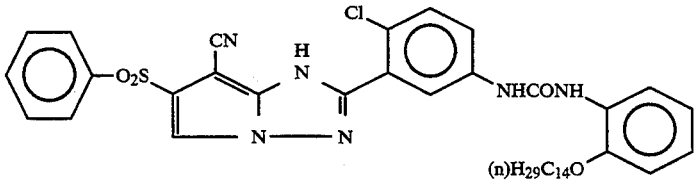
(8)
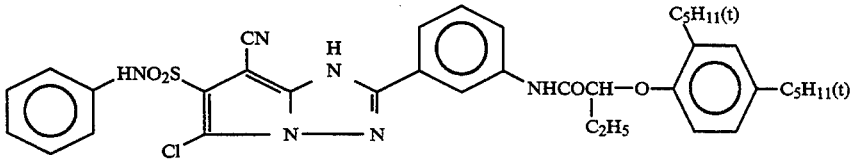
(9)
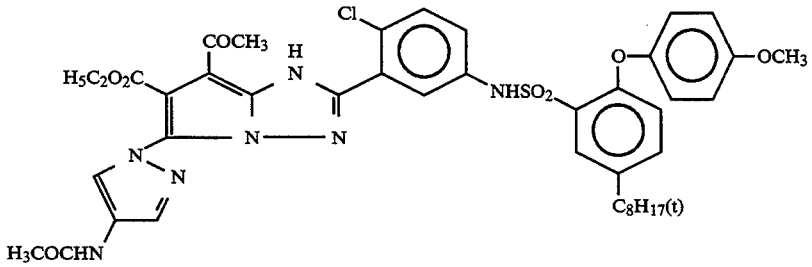
(10)
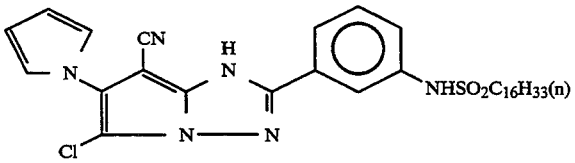
(11)
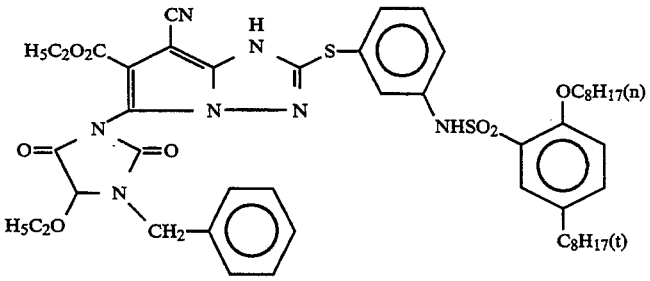

-continued
(12)
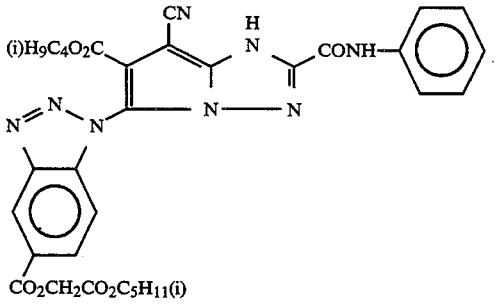
(13)
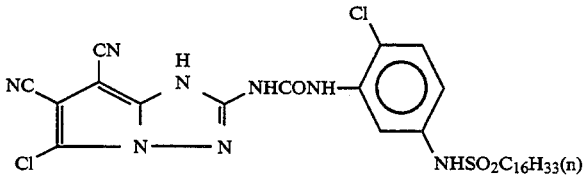
(14)
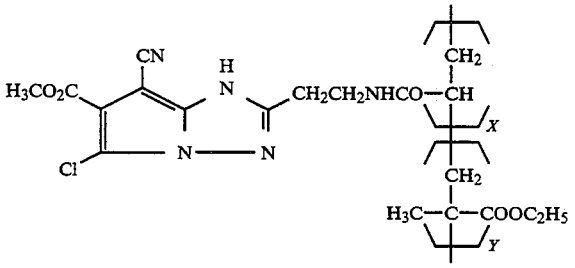
X:Y = 50:50
(15)
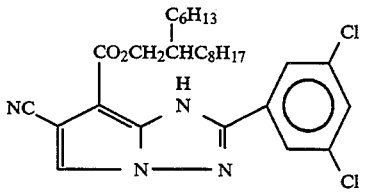
(16)
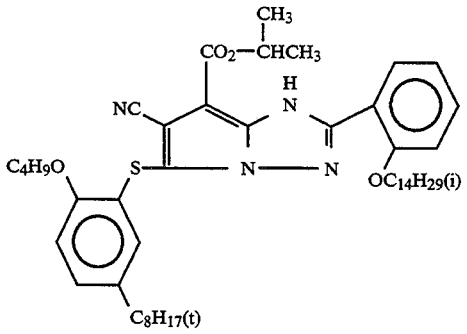
(17)
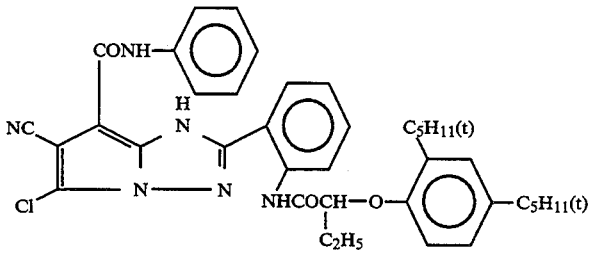

-continued
(18)
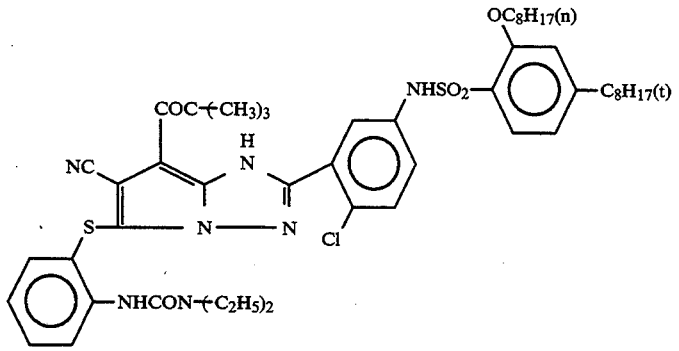
(19)
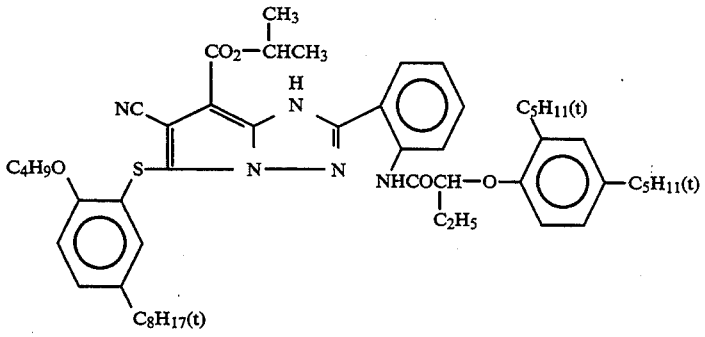
(20)
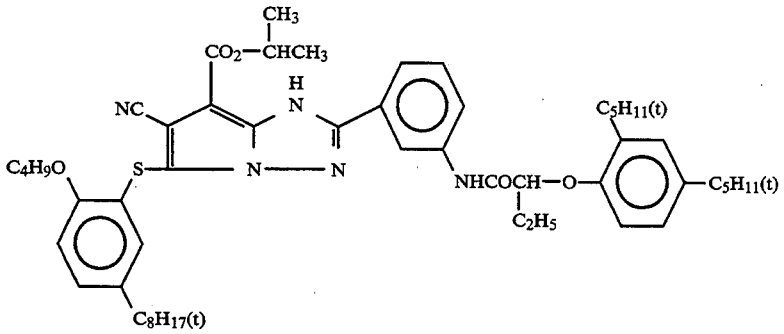
(21)
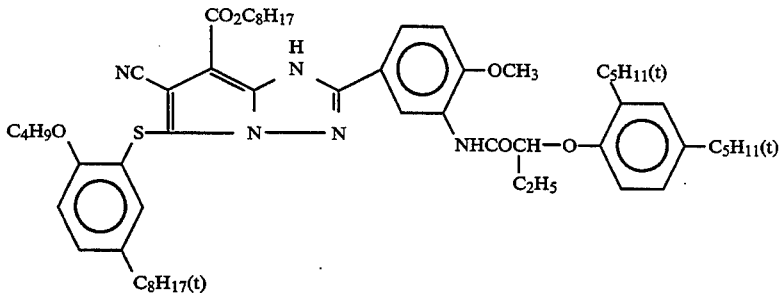
(22)
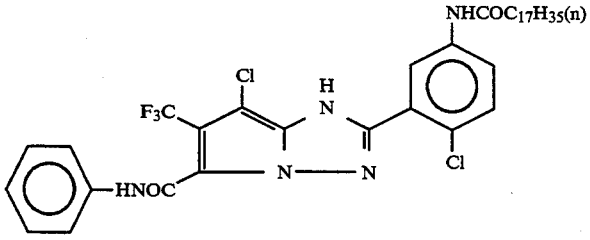

-continued
(23)
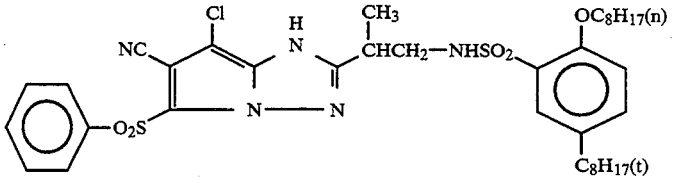
(24)
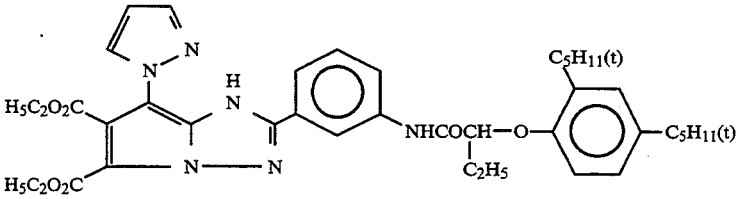
(25)
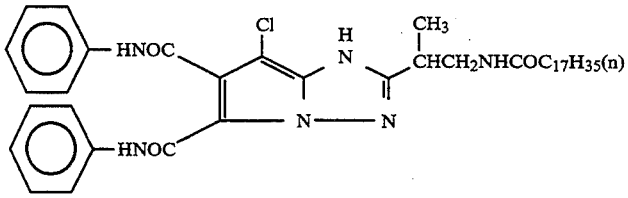
(26)
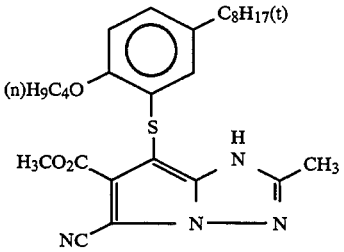
(27)
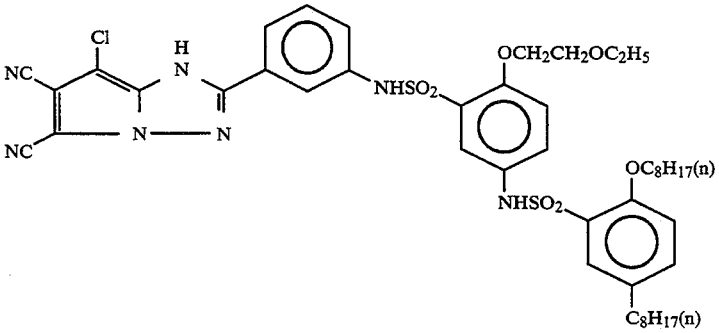
(28)
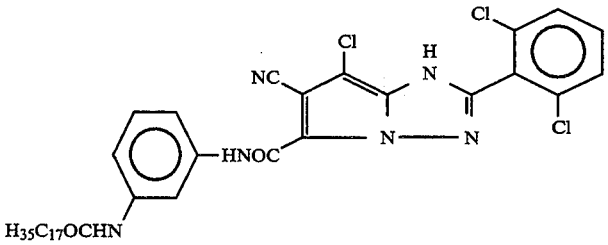
(29)
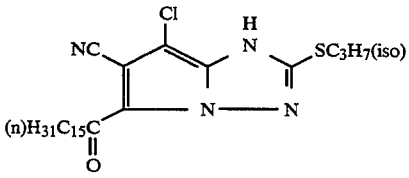

-continued
(30)
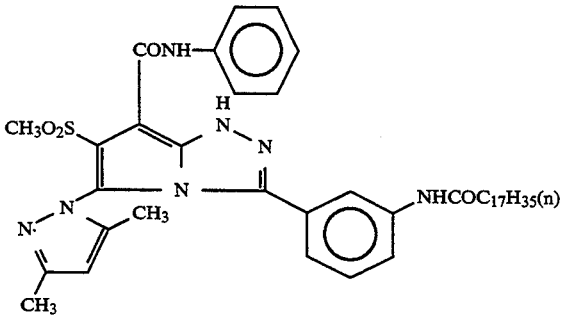
(31)
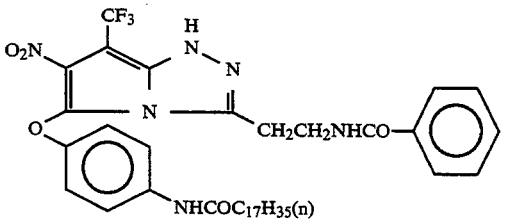
(32)
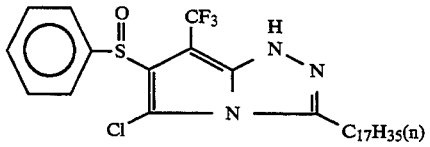
(33)
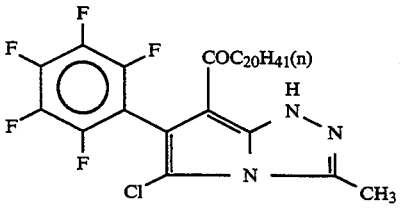
(34)
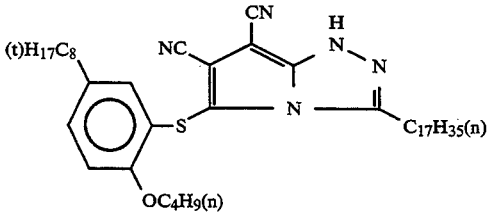
(35)
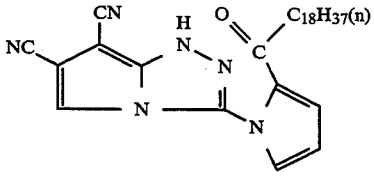
(36)
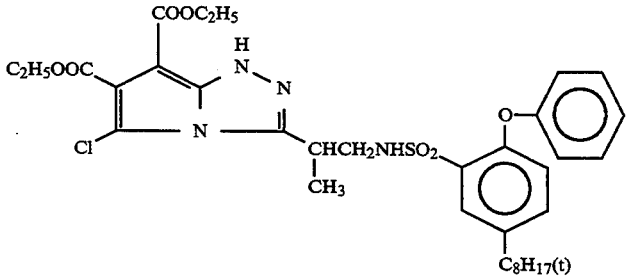

-continued
(37)
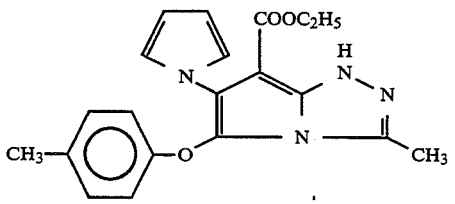
(38)
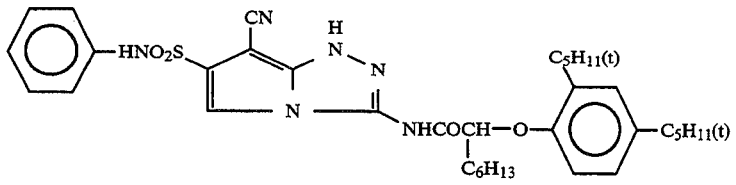
(39)
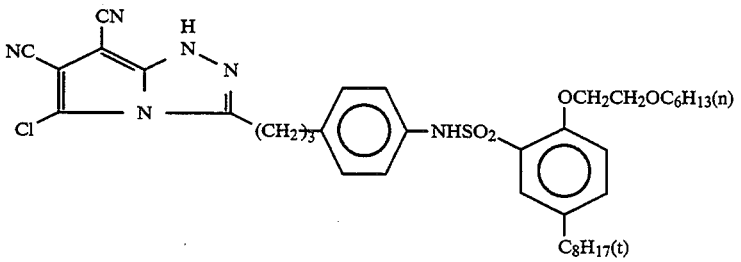
(40)
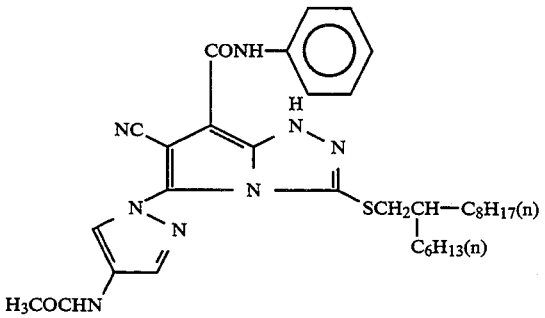
(41)
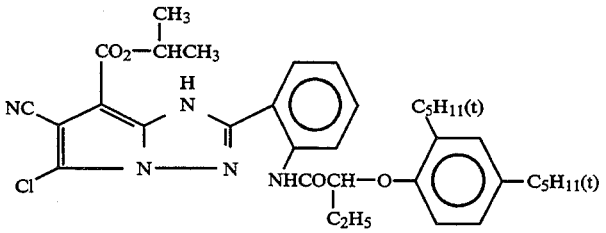
(42)
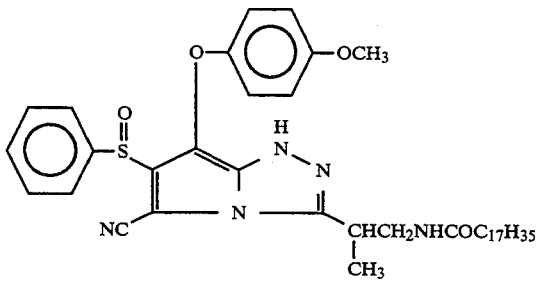
(43)
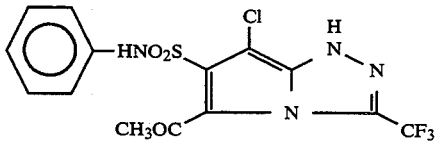

-continued
(44)
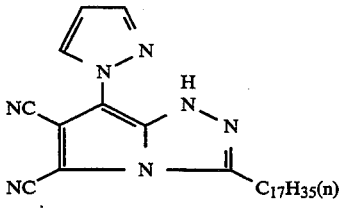
(45)
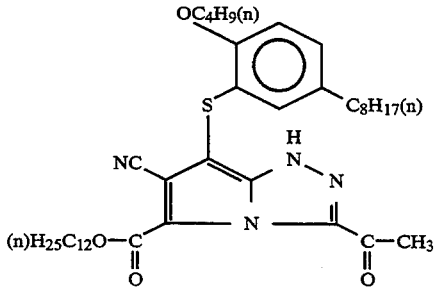
(46)
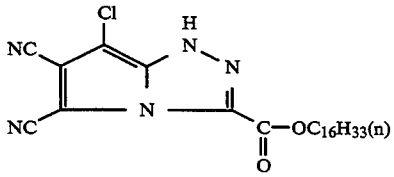
(47)
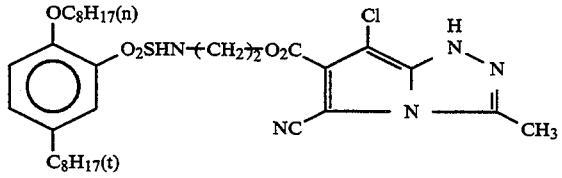
(48)
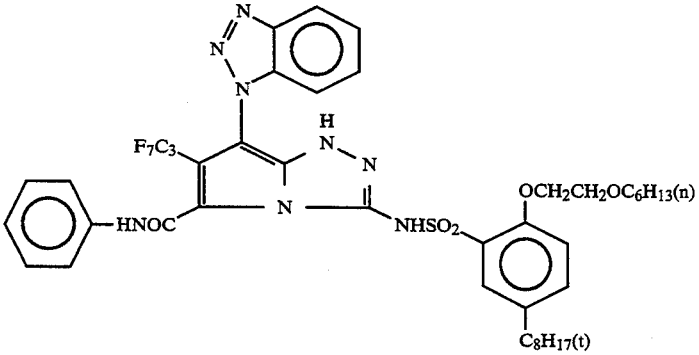
(49)
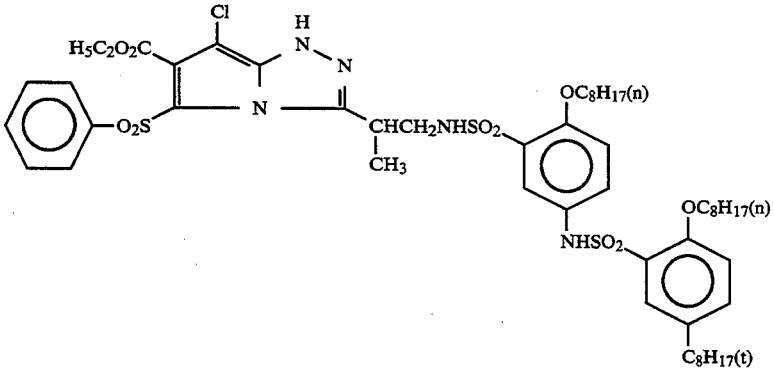

-continued
(50)
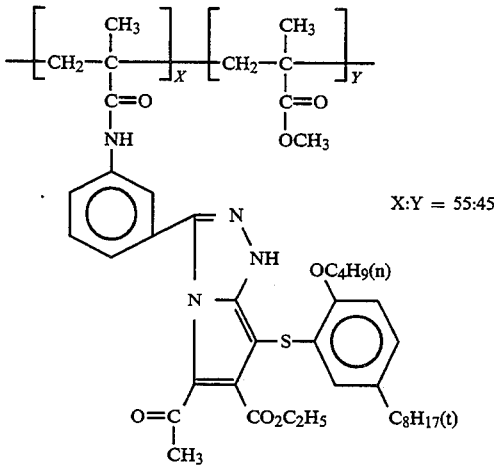
(51)
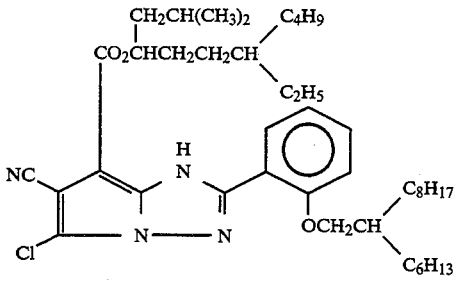
(52)
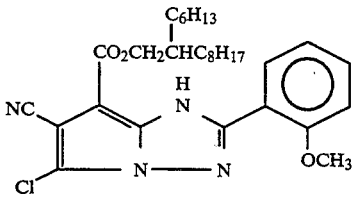
(53)
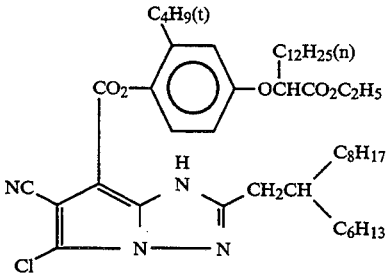
(54)
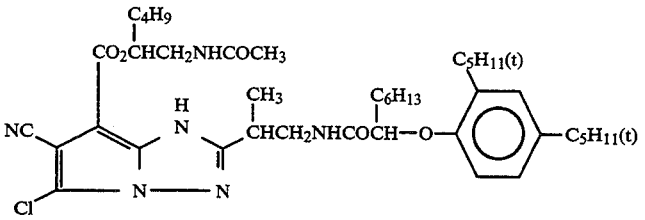

-continued
(55)
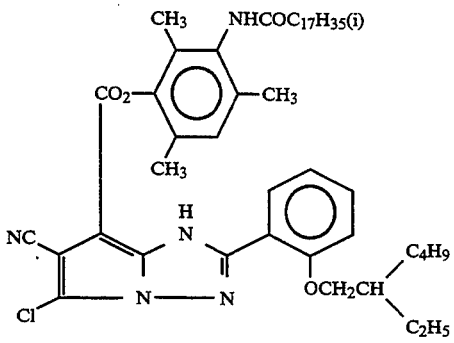
(56)
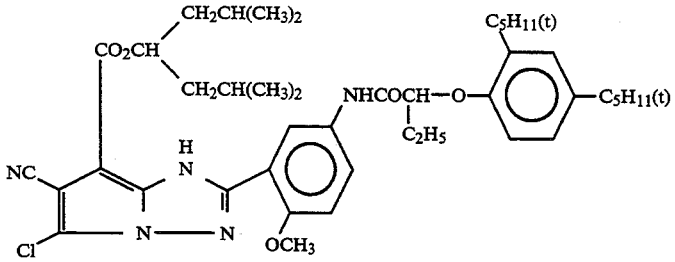
(57)
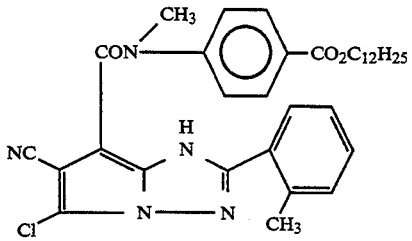
(58)
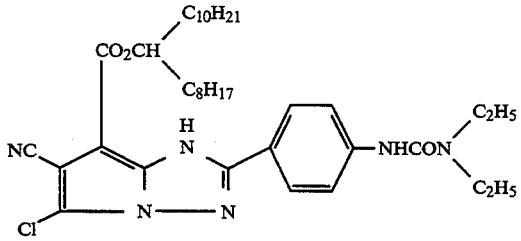
(59)
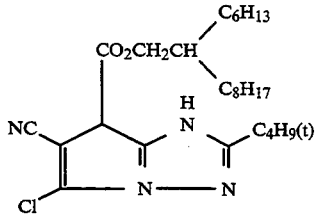
(60)
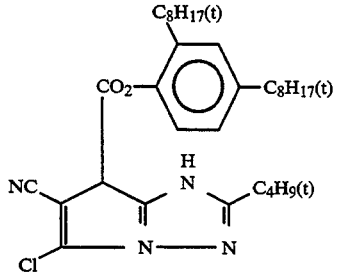
Examples of the synthesis of the cyan coupler of the present invention will be given below to describe the synthesis method of the cyan coupler of the present invention.

SYNTHESIS EXAMPLE 1

(Synthesis of Exemplary Compound (1))

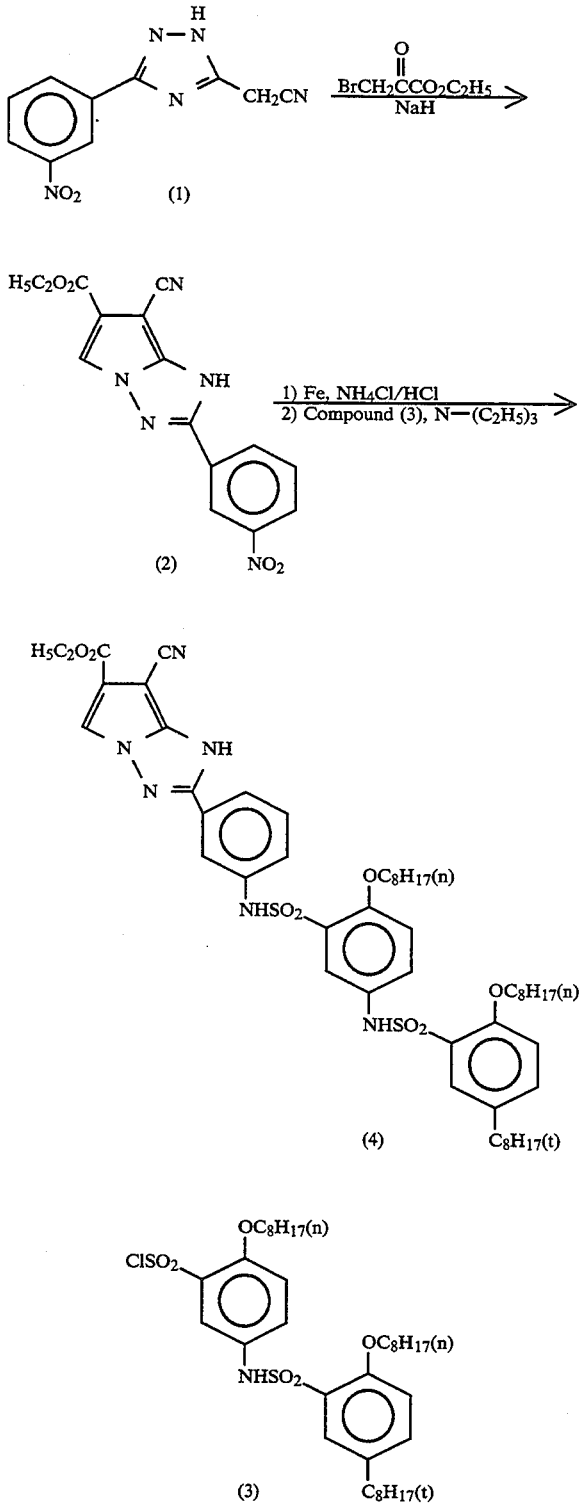

-continued

SYNTHESIS EXAMPLE 1

(Synthesis of Exemplary Compound (1))

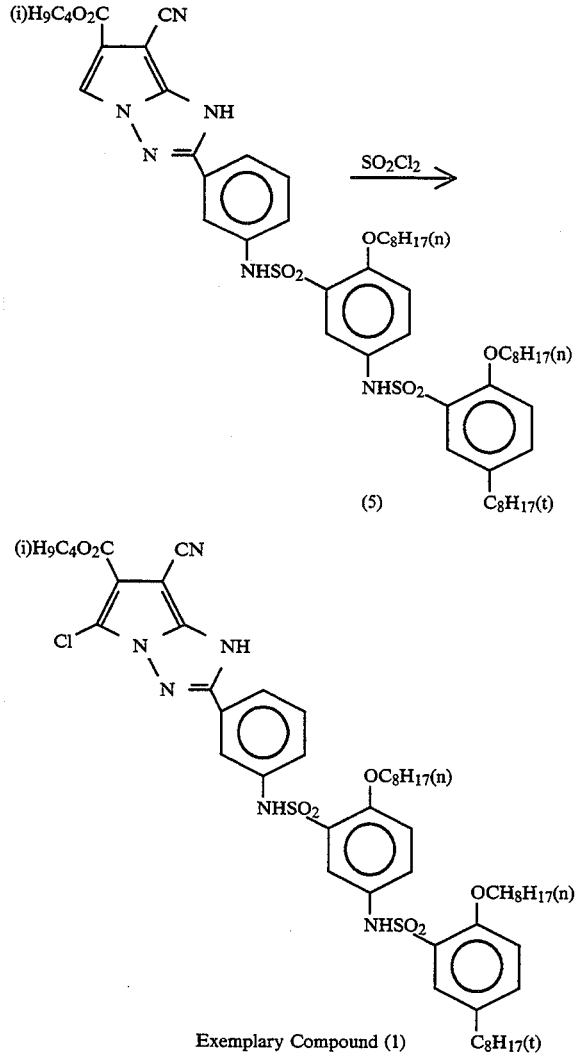

Exemplary Compound (1)

20.0 g (87.3 mmol) of 3-m-nitrophenyl-5-methylcyano-1,2,4-triazole (1) was dissolved in 150 ml of dimethyl acetamide. 7.3 g (183 mmol) of a 60% NaOH oil solution was gradually added to the solution. The mixture was heated to a temperature of 80° C. A solution of 13.1 ml (105 mmol) of ethyl bromopyruvate in 50 ml of dimethyl acetamide was gradually added dropwise to the material. The mixture was then stirred at a temperature of 80° C. for 30 minutes after the dropwise addition. The material was allowed to cool to room temperature. The reaction solution was acidified with a 1N hydrochloric acid, extracted with ethyl acetate, dried with Glauber's salt, and then distilled off under reduced pressure. The resulting residue was then purified through silica gel chromatography to obtain 10.79 g (yield: 38%) of Compound (2).

9.26 g (166 mmol) of reduced iron and 0.89 g (16.6 mmol) of ammonium chloride were suspended in 300 ml of isopropanol. 30 ml of water and 2 ml of concentrated sulfuric acid were then added to the suspension. The reaction solution was then heated under reflux for 30 minutes with 10.79 g (33.2 mmol) of Compound (2) being gradually added thereto. The reaction solution was further heated under reflux for 4 hours. The residue was then filtered off through Celite. The filtrate was distilled off under reduced pressure. The residue was then dissolved in a mixture of 40 ml of dimethyl acetamide and 60 ml of ethyl acetate. 25.6 g (36.5 mmol) of Compound (3) was then added to the solution. 23.1 ml (166 mmol) of triethylamine was then added to the solution. The solution was then heated to a temperature of 70° C. for 5 hours. The reaction solution was then allowed to cool to room temperature. Water was then added to the reaction solution. The reaction solution was then extracted with ethyl acetate. The extract was washed with water, dried with Glauber's salt, and then distilled off under reduced pressure. The resulting residue was then purified through silica gel chromatography to obtain 16.5 g (yield: 52%) of Compound (4).

7.0 g (7.30 mmol) of Compound (4) was dissolved in 14 ml of isobutanol. 0.43 ml (1.46 mmol) of tetraisopropyl orthotitanate was added to the solution. The reaction solution was then heated under reflux for 6 hours. The reaction solution was then allowed to cool to room temperature. Water was added to the material. The material was extracted with ethyl acetate, dried with Glauber's salt, and then distilled off under reduced pressure. The resulting residue was then purified through silica gel chromatography to obtain 5.0 g (yield: 69%) of Compound (5).

5.0 g (5.04 mmol) of Compound (5) was dissolved in 50 ml of tetrahydrofuran. 0.40 ml (5.04 mmol) of $SO_2Cl_2$ was added dropwise to the solution under cooling with water. After dropwise addition, the reaction solution was then stirred under cooling with water for 4 hours. Water was then added to the reaction solution. The reaction solution was extracted with ethyl acetate, dried with Glauber's salt, and then distilled off under reduced pressure. The resulting residue was then purified through silica gel chromatography to obtain 3.9 g (yield: 76%) of Exemplary Compound (1).

SYNTHESIS EXAMPLE 2
(Synthesis of Exemplary Compound (39))

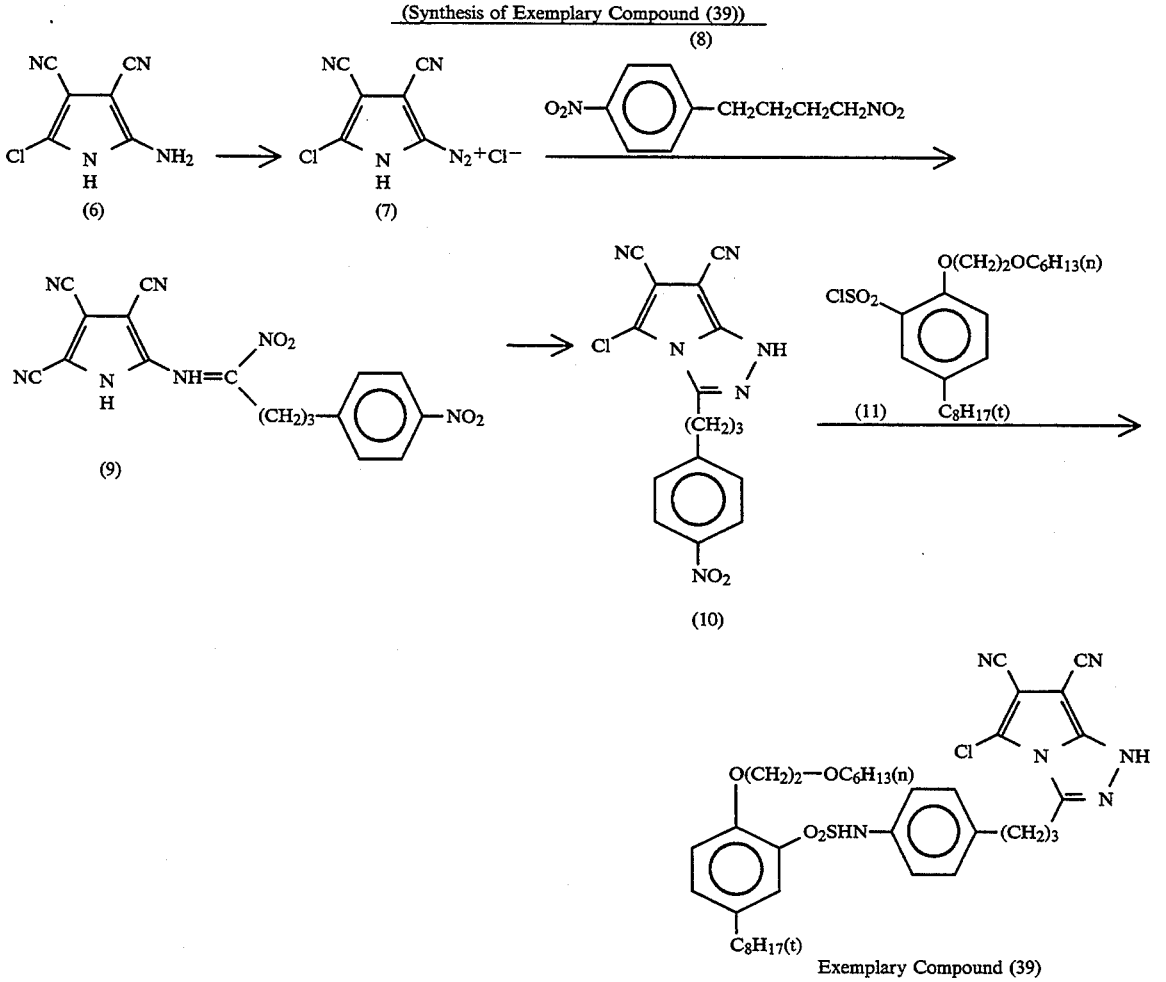

38 ml of a 36 % hydrochloric acid solution was added to 6.78 g (40.7 mmol) of 2-amino-5-chloro-3,4-dicyanopyrrole (6). A solution of 2.95 g (42.7 mmol) of sodium sulfite in 5.9 ml of water was then gradually added dropwise to the mixture with stirring under cooling with ice. The reaction solution was further stirred for 1.5 hours under the same conditions to prepare Compound (7). 102 ml of 28 % sodium methylate was added to a solution of 9.58 g (427 mmol) of Compound (8) in 177 ml of ethanol with stirring under cooling with ice to prepare a solution. To the solution was then gradually added dropwise Compound (7) with stirring under cooling with ice. The reaction solution was further stirred for 1 hour (to obtain Compound (9)). The reaction solution was then heated under reflux with stirring for 1.5 hours. The reaction solution was then distilled off under reduced pressure to remove ethanol therefrom. The residue was then dissolved in chloroform. The solution was washed with saturated brine, dried with Glauber's salt, and then distilled off under reduced pressure to remove chloroform therefrom. The residue was then purified through silica gel chromatography to obtain 4.19 g (yield: 29 % from Compound (6)) of Compound (10).

The synthesis of Compound (6) was accomplished by chlorinatng 3,4-dicyanopyrrole, nitrating the chlorinated compound, and then reducing the material with iron. Compound (8) was synthesized from Compound (a) which had been prepared from γ-lactone and benzene by a known method in accordance with the method disclosed in "Journal of the American Chemical Society", 76, 3209 (1954).

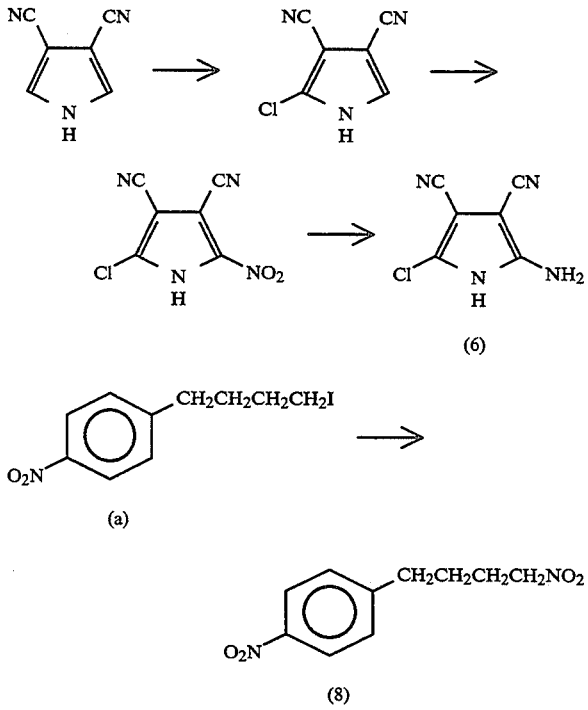

To 3.3 g (59.0 mmol) of powdered reduced iron were added 10 ml of water, 0.3 g (5.9 mmol) of ammonium chloride and 0.34 ml (5.9 mmol) of acetic acid. The mixture was then heated under reflux with stirring for 15 minutes. To the reaction solution was added 31 ml of isopropanol. The reaction solution was then heated under reflux with stirring for 20 minutes. To the reaction solution was added dropwise a solution of 4.1 g (11.8 mmol) of Compound (10) in 14 ml of isopropanol. The reaction solution was then heated under reflux with stirring for 2 hours. The reaction solution was then filtered off with Celite as a filtering aid. The residue was washed with ethyl acetate. The filtrate was distilled off under reduced pressure.

The residue was dissolved in a mixture of 16 ml of ethyl acetate and 24 ml of dimethyl acetamide. To the reaction solution was added 5.6 g (13.0 mmol) of Compound (11). 8.2 ml (59.0 mmol) of triethylamine was added to the reaction solution. The reaction solution was stirred at room temperature for 4 hours. Water was added to the reaction solution. The reaction solution was extracted with ethyl acetate. The extract was washed with saturated brine, dried with Glauber's salt, and then distilled off under reduced pressure. The residue was purified through silica gel chromatography to obtain 6.46 g (yield: 76 %) of Exemplary Compound (39).

The compound of the present invention represented by the general formula (A), (B), (C) or (D) will be further described hereinafter.

Upon reaction with an aromatic primary amine color developing agent or an oxidation product thereof, the lipophilic compounds represented by formula (A), (B), (C), or (D) form a substantially colorless product. The term "substantially colorless product" herein used means a compound having no main absorption at the wavelength of not shorter than 400 nm in a UV or visible spectrum and causing no stains in unexposed areas or white portions of the resulting developed color photographic material.

$R_{a1}$ and $R_{a2}$ will be further described hereinafter. Examples of the aliphatic group represented by $R_{a1}$ or $R_{a2}$ include methyl, i-propyl, t-propyl, t-butyl, benzyl, 2-hydroxybenzyl, cyclohexyl, t-octyl, vinyl, allyl, and n-pentadecyl. The aliphatic group is preferably a $C_{1-30}$ alkyl group which may be substituted. Examples of the aromatic group represented by $R_{a1}$ or $R_{a2}$ include phenyl and naphthyl. The aromatic group is preferably a $C_{6-36}$ phenyl group which may be substituted. Examples of the heterocyclic group represented by $R_{a1}$ or $R_{a2}$ include thienyl, furyl, chromanyl, morpholinyl, piperazyl, and indolyl. Examples of the acyl group represented by $R_{a2}$ include acetyl, tetradecanoyl, and benzoyl. The acyl group represented by $R_{a2}$ is preferably a $C_{2-37}$ acyl group which may be substituted. Examples of the sulfonyl group represented by $R_{a2}$ include methanesulfonyl and benzenesulfonyl. The sulfonyl group represented by $R_{a1}$ is preferably a $C_{1-36}$ sulfonyl group which may be substituted. Examples of the carbamoyl group represented by $R_{a2}$ include methylcarbamoyl, diethylcarbamoyl, octylcarbamoyl, phenylcarbamoyl, and N-methyl-N-phenylcarbamoyl. The carbamoyl group is preferably a $C_{2-37}$ carbamoyl group which may be substituted. Examples of the sulfamoyl group represented by $R_{a2}$ include methylsulfamoyl, diethylsulfamoyl, octylsulfamoyl, phenylsulfamoyl, and N-methyl-N-phenylsulfamoyl. The sulfamoyl group is preferably a $C_{2-37}$ sulfamoyl group which may be substituted.

Examples of the heterocyclic group which is connected to the rest of the molecule via a nitrogen atom represented by $Z_{a2}$ include 1-pyrrolyl, 1-imidazolyl, 1-pyrazolyl, 2-indolyl, 1-indole, and 7-prinyl. The heterocyclic group is preferably a heterocyclic group which forms an aromatic ring. The aromatic group and heterocyclic group represented by $R_{a3}$, $R_{a4}$ and $R_{a5}$ and the aliphatic group represented by $R_{a5}$ have the same meaning as the aromatic group, heterocyclic group and aliphatic group represented by $R_{a1}$ and $R_{a2}$.

The aliphatic group represented by $R_{b1}$ has the same meaning as that represented by $R_{a1}$ and $R_{a2}$. Examples of the halogen atom represented by $Z_{b1}$ include chlorine, bromine, and iodine.

$Z_{c1}$ will be further described hereinafter. The acyl group, carbamoyl group, sulfamoyl group and sulfonyl group represented by $Z_{c1}$ have the same meaning as that represented by $R_{a2}$. Examples of the aliphatic oxycarbonyl group represented by $Z_{c1}$ include methoxycarbonyl, ethoxycarbonyl, i-propoxycarbonyl, benzyloxycarbonyl, cyclohexyloxycarbonyl, n-hexadecyloxycarbonyl, allyloxycarbonyl, and pentadecenyloxycarbonyl. The aliphatic oxycarbonyl group is preferably a $C_{2-3}$ alkyloxycarbonyl group which may be substituted. Examples of the aromatic oxycarbonyl group represented by $Z_{c1}$ include phenyloxycarbonyl, and naphthyloxycarbonyl. The aromatic oxycarbonyl group is preferably a $C_{7-37}$ phenyloxycarbonyl group which may be substituted. The aliphatic group, aromatic group and heterocyclic group represented by $R_{c1}$, $R_{c2}$ and $R_{c1}$ have the same meaning as that represented by $R_{a1}$ and $R_{a2}$.

The aliphatic group and aromatic group represented by $R_{d1}$ to $R_{d10}$ and $R_{d12}$ and the heterocyclic group represented by $R_{d2}$ to $R_{d9}$ and $R_{d12}$ have the same meaning as that represented by $R_{a1}$ and $R_{a2}$. Examples of the atom or atom group represented by Y which forms an inorganic or organic salt include Li, Na, K, Ca, Mg, triethylamine, methylamine, and ammonia. The acyl group and sulfonyl group represented by $R_{a4}$, $R_{d5}$, $R_{d7}$ and $R_{d8}$ have the same meaning as that represented by $R_{a2}$. The aliphatic oxycarbonyl group represented by $R_{d4}$, $R_{d5}$, $R_{d7}$ and $R_{d8}$ have the same meaning as that represented by $Z_{c1}$. Examples of the ureide group represented by and $R_{d8}$ include phenylureide, methylureide, N,N-dibutylureide, and N-phenyl-N-methyl-N'-methylureide. The ureide group is preferably a $C_{2-37}$ ureide group. Examples of the urethane group represented by $R_{d4}$, $R_{d1}$, $R_{d7}$ and $R_{d8}$ include methylurethane, and phenylurethane. The urethane group is preferably a $C_{2-37}$ urethane group.

The acyl group represented by $R_{d6}$ has the same meaning as that represented by $R_{a2}$. The aliphatic oxycarbonyl group and aromatic oxycarbonyl group represented by $R_{d6}$ have the same meaning as that represented by $Z_{c1}$.

Examples of the aliphatic amino group represented by $R_{d6}$ include methylamino, diethylamino, octylamino, benzylamino, cyclohexylamino, dodecylamino, allylamino, and hexadecylamino. The aliphatic amino group is preferably a $C_{1-30}$ alkylamino group which may be substituted. Examples of the aromatic amino group represented by $R_{d6}$ include anilino, 2,4-dichloroanilino, 4-t-octylanilino, N-methyl-anilino, 2-methylanilino, and N-hexadecylanilino. The aromatic amino group is preferably a $C_{6-37}$ anilino group which may be substituted. Examples of the aliphatic oxy group represented by $R_{d6}$ include methoxy, ethoxy, t-butyloxy, benzyloxy, and cyclohexyloxy. The aliphatic oxy group is preferably a $C_{1-30}$ alkoxy group which may be substituted. Examples of the aromatic oxy group represented by $R_{a6}$ include phenoxy, 2,4-di-t-butylphenoxy, 2-chlorophenoxy, and 4-methoxyphenoxy. The aromatic oxy group is preferably a $C_{6-37}$ phenoxy group which may be substituted.

Examples of the halogen atom represented by $R_{d10}$ include chlorine, bromine, and iodine. Examples of the acyloxy group represented by $R_{10}$ include acetyloxy, and benzoyloxy. The acyloxy group is preferably a $C_{2-37}$ acyloxy group which may be substituted. The sulfonyl group represented by $R_{d10}$ has the same meaning as that represented by $R_{a2}$.

Examples of the hydrolyzable group represented by $R_{d11}$ include an acyl group, sulfonyl group, oxazolyl group, and silyl group.

Examples of the 5- to 7-membered rings formed by at least two of $R_{a1}$, $R_{a2}$ and $Z_{a2}$ connected each other include piperazine ring, piperidine ring, merphorine ring, indoline ring, indazole ring, ethylenecarbonate ring, ethyleneurea ring, and phthalic anhydride. Examples of the 5- to 7-membered rings formed by at least two of $R_{c1}$, $R_{c2}$, $R_{c3}$, and $Z_{c1}$ connected each other include maleimide ring, cyclohexene ring, cyclopentene ring, cyclohepene ring, cyclohexane ring, cyclopentane ring, cycloheptane ring, and oxepine ring. Examples of the 5- to 7-membered rings formed by $R_{d2}$ and $R_{d3}$ when connected each other include cyclopentane ring, cyclohexane ring, dioxane ring, thiane ring, and pyrrolidine ring. Examples of the 5-to 7-membered rings formed by at least two of $R_{d7}$, $R_{d8}$, and $R_{d9}$ connected each other include pyrazolidine ring, pyrazolidinone ring, and hexahydropyridazine ring.

The compounds represented by the general formulae (A) to (C) preferably exhibit a secondary reaction rate constant $k_2$ (80° C.) of from 1.0 l/mol·sec to $1\times10^{-2}$ l/mol·sec with panisidine as determined by the method described in European Patent Application 258662A.

Preferred among the compounds represented by the general formula (D) are those wherein $R_{d1}$ is an aromatic group. When $Z_{d1}$ is $-SO_2Y$ in which Y is a hydrogen atom or atom or atom group which forms an inorganic or organic salt, $R_{d1}$ is preferably a phenyl group containing a substituent whose total Hammett's $\sigma$ value with respect to $-SO_2Y$ is 0.5 or more, but preferably not more than 2.0 and more preferably 1.5 or less. In this case, the $\sigma_p$ value is substituted for the $\sigma_o$ value. The total Hammetts' $\sigma$ value in the compound of formula (D) means the sum of $\sigma_p$ value, $\sigma_m$ value and $\sigma_o$ value, each of which indicates quantitatively the electronic effect of the substituent at the respective substitution position of the benzene derivative.

Preferred among the compounds represented by the general formulae (A) to (D) are those represented by the general formulae (A) and (D).

Preferred among the compounds represented by the general formula (A) are those represented by the following general formulae (A-I) to (A-V):

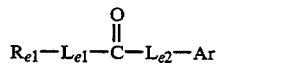
(A-I)

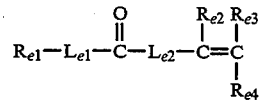
(A-II)

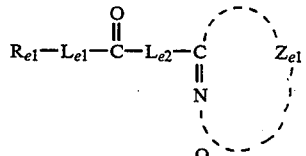
(A-III)

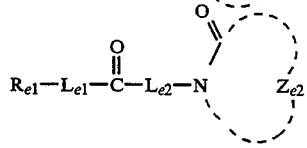
(A-IV)

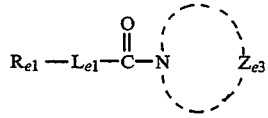
(A-V)

In the general formulae (A-I) to (A-V), $R_{e1}$ has the same meaning as $R_{a1}$ in the general formula (A). $L_{e1}$ represents a single bond or —O—. $L_{e2}$ represents —O—or —S—. Ar represents an aromatic group. $R_{e2}$ to $R_{e4}$ may be the same or different and each represents a hydrogen atom, aliphatic group, aromatic group, heterocyclic group, aliphatic oxy group, aromatic oxy group, heterocyclic oxy group, aliphatic thio group, aromatic thio group, heterocyclic thio group, amino group, aliphatic amino group, aromatic amino group, heterocyclic amino group, acyl group, amide group, sulfonamide group, sulfonyl group, aliphatic oxycarbonyl group, aromatic oxycarbonyl group, sulfo group, carboxyl group, formyl group, hydroxyl group, acyloxy group, ureide group, urethane group, carbamoyl group or sulfamoyl group. At least two of $R_{e2}$ to $R_{e4}$ may be connected to each other to form a 5- to 7-membered ring such as 4H-pyran-4-one ring, 2,5-cyclohexadiene-l-one ring, 4-pyridone ring, cyclopentene ring, cyclohexene ring, cyclohexenone ring, and pyrazole ring. $Z_{e1}$ and $Z_{e2}$ each represents a nonmetallic atom group required for the formation of a 5- to 7-membered ring, exemplified with pyridine ring, pyrazoline ring, indazole ring, pyrazolone ring, triazole ring, phthalazinone ring, oxazolone ring and thiazolidinone ring for $Z_{e1}$, and pyrazolidone ring, succinic imide ring, and glutaric imide ring for $Z_{e2}$. $Z_{e3}$ represents a nonmetallic atom group required for the formation of a 5- to 7-membered aromatic ring such as pyridine ring, triazole ring, pyrazole ring, and imidazole ring. The ring formed by $Z_{e1}$ to $Z_{e3}$ may contain substituents, may form a spiro ring or bicyclo ring or may be condensed with a benzene ring, alicyclic group or heterocyclic group.

Particularly preferred among the compounds represented by the general formulae (A-I) to (A-V) are those represented by the general formulae (A-I) to (A-III).

Preferred examples of substituents that the respective groups in the general fomulae (A) to (D) may be substituted include a halogen atom, alkyl group, alkoxycarbonyl group, aryl group, sulfonyl group, alkoxy group, aryloxy group, acyloxy group, nitro group, cyano group, acyl group, acylamino group, carbamoyl group, heterocyclic group, alkylthio group, aryloxycarbonyl group, and sulfonyl group.

Typical examples of these compounds are given below, but the present invention should not be construed as being limited thereto.

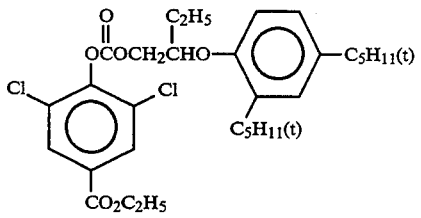

(ST-1)

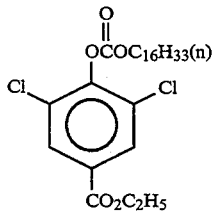

(ST-2)

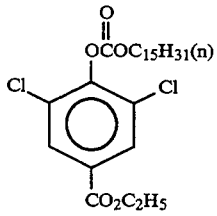

(ST-3)

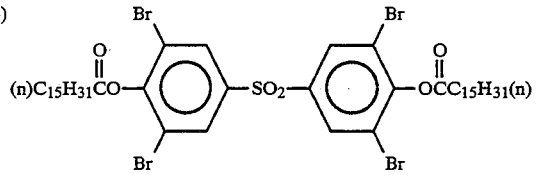

ST-4)

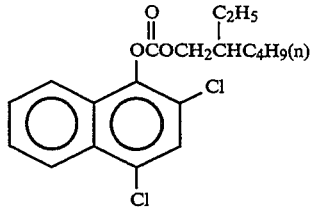

(ST-5)

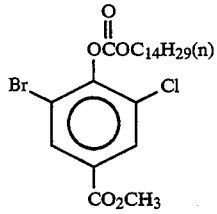

(ST-6)

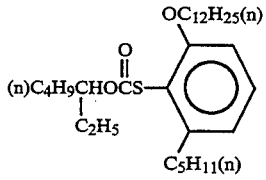

(ST-7)

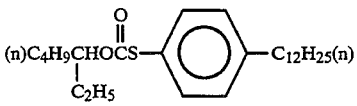

(ST-8)

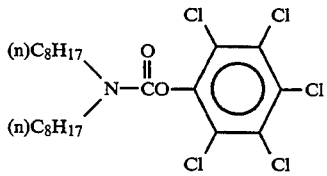

(ST-9)

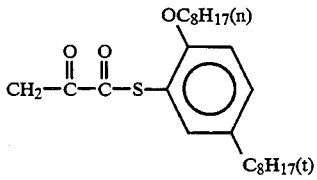

(ST-10)

-continued
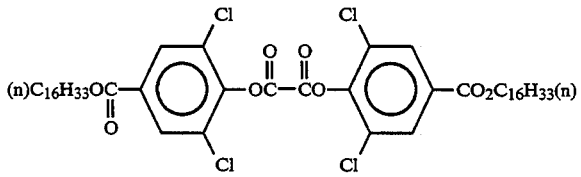
(ST-11)
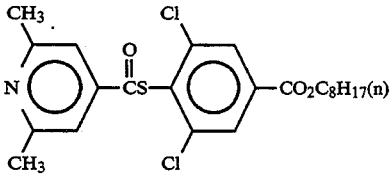
(ST-12)
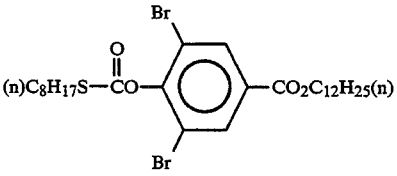
(ST-13)
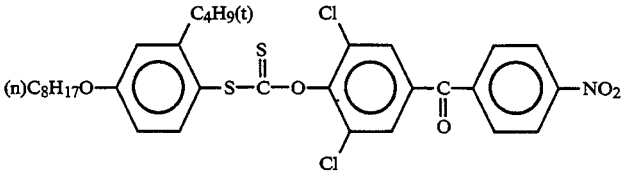
(ST-14)
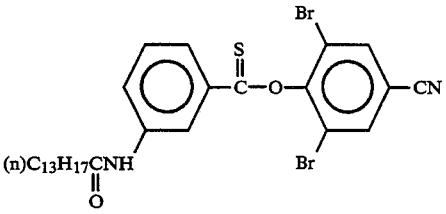
(ST-15)
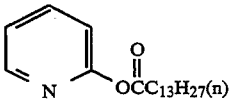
(ST-16)
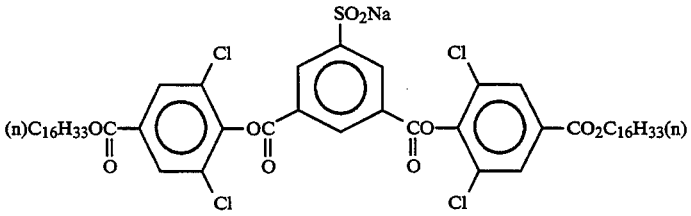
(ST-17)
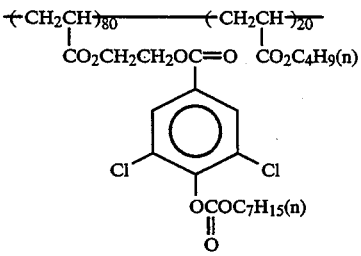
(ST-18)
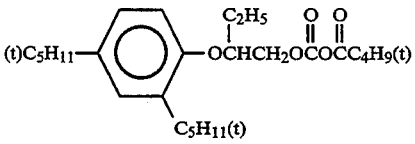
(ST-19)
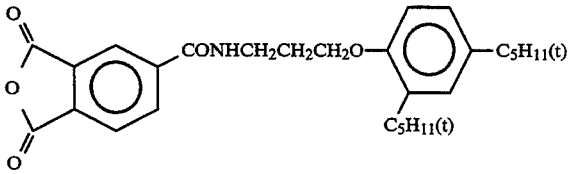
(ST-20)
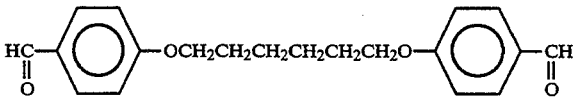
(ST-21)

-continued
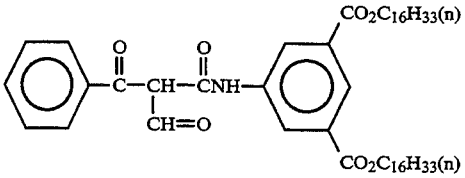
(ST-22)
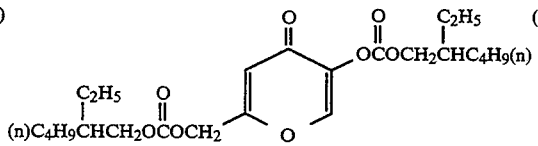
(ST-23)
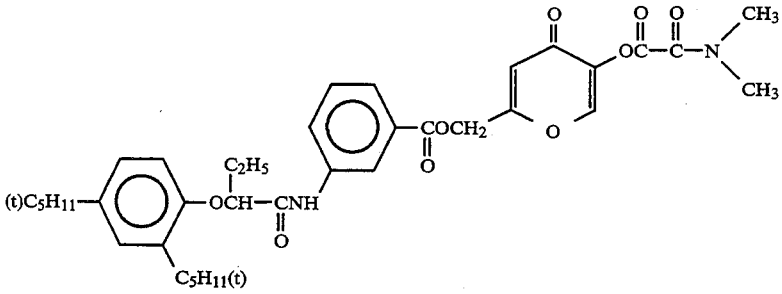
(ST-24)
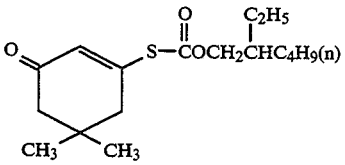
(ST-25)
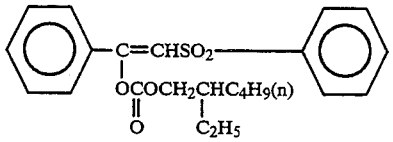
(ST-26)
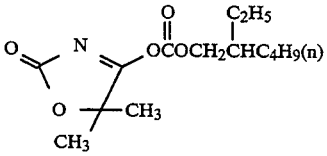
(ST-27)
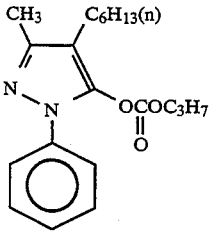
(ST-28)
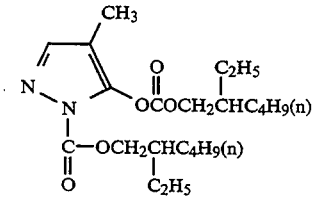
(ST-29)
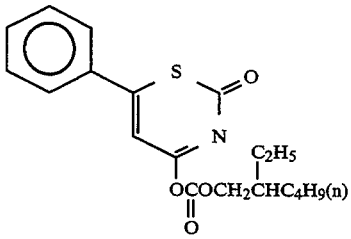
(ST-30)
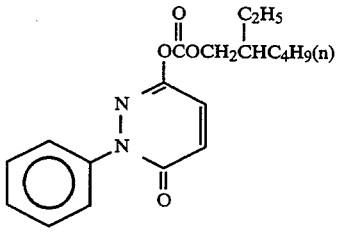
(ST-31)
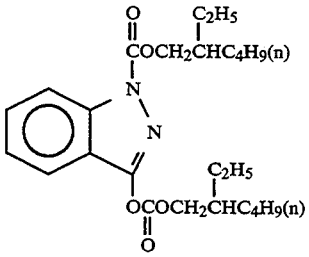
(ST-32)
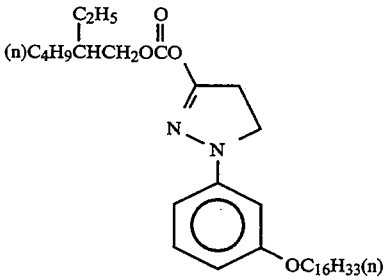
(ST-33)

-continued
(ST-34)
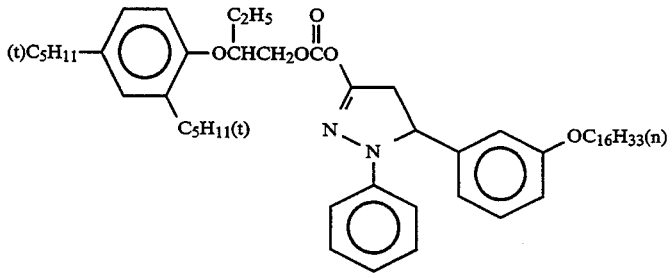
(ST-35)
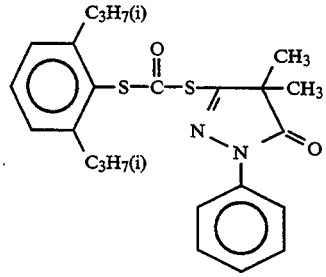
(ST-36)
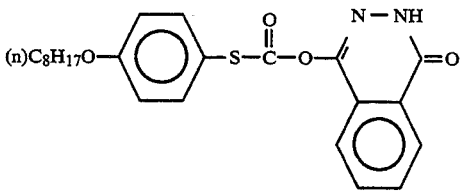
(ST-37)
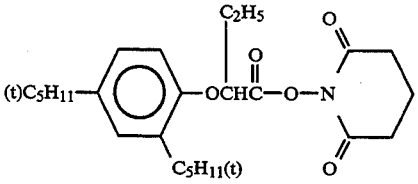
(ST-38)
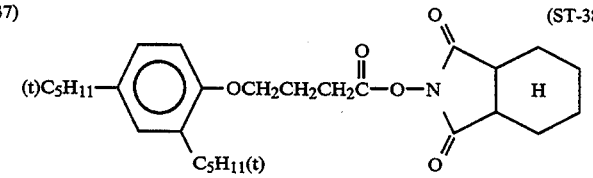
(ST-39)
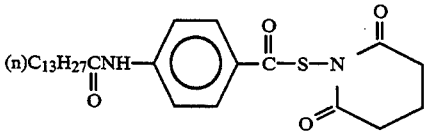
(ST-40)
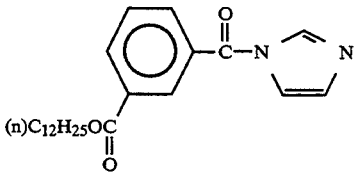
(ST-41)
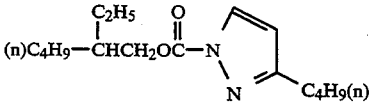
(ST-42)
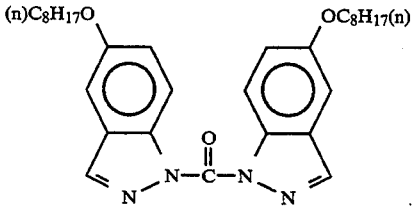
(ST-43)
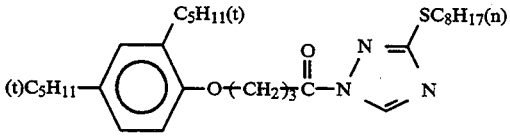
(ST-44)
$(n)C_{18}H_{37}Br$
(ST-45)
$(n)C_{18}H_{37}I$
(ST-46)
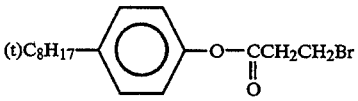
(ST-47)
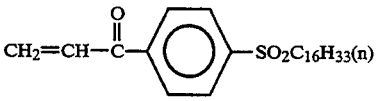
(ST-48)
$CH_2{=}CH{-}SO_2{-}C_{18}H_{37}(n)$ -continued
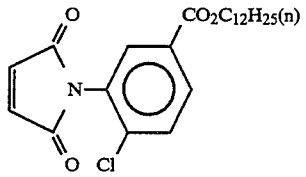
(ST-49)
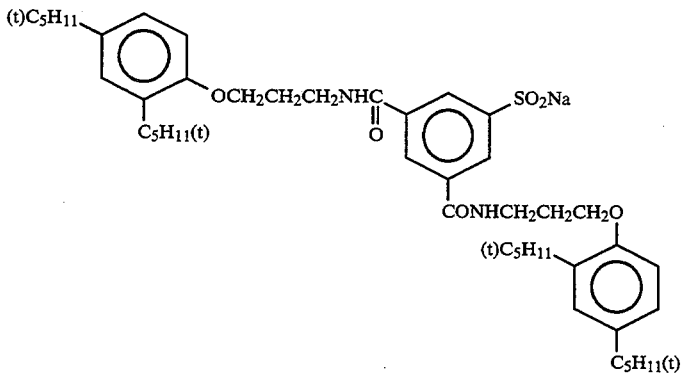
(ST-50)
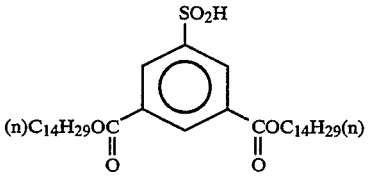
(ST-51)
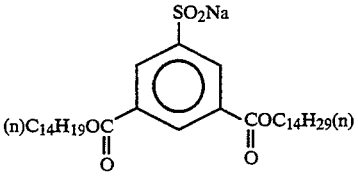
(ST-52)
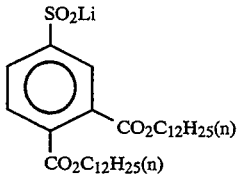
(ST-53)
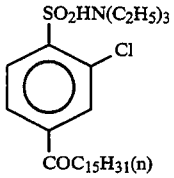
(ST-54)
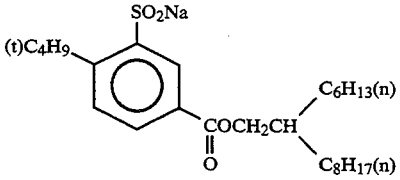
(ST-55)
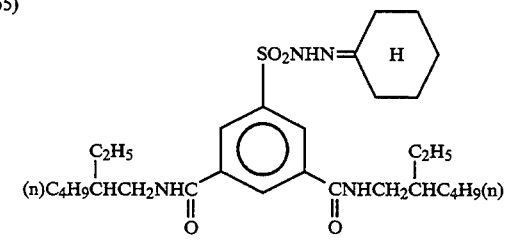
(ST-56)
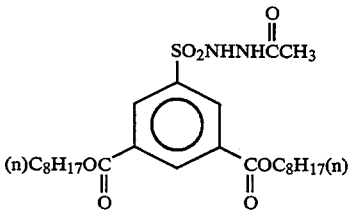
(ST-57)
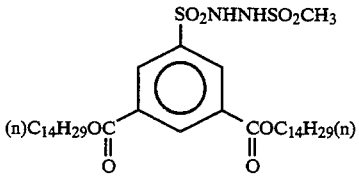
(ST-58)
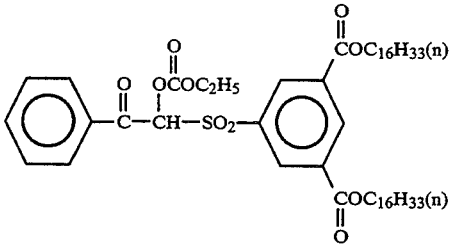
(ST-59)
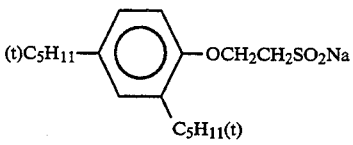
(ST-60)

-continued (ST-61)

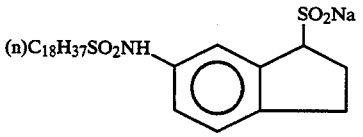

(ST-62)

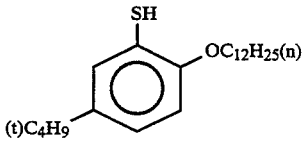

(ST-63)

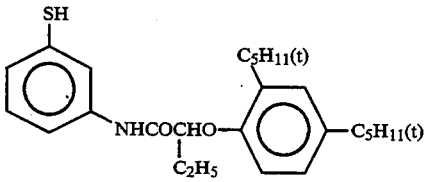

(ST-64)

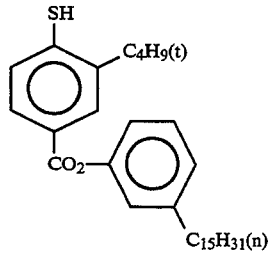

These compounds of the general formulae (A) (B) (C) and (D) can be synthesized by the methods disclosed in JP-A-62-143048, 63-115855, 63-115866, and 63-158545 (the term "JP-A" as used herein means an "unexamined published Japanese patent application"), and European Patent 255,722 and their equivalents.

Preferred examples of the compounds of the present invention include those exemplified in JP-A-62-17665, 62-283338, 62-229145, 64-86139, and 1-271748, and Hatsumei Kyokai Kokai Giho Kogi No. 90-9416.

The content of the compounds of the general formulae (A) to (D) depends on the kind of couplers to be used and is normally in the range of 0.5 to 300 mol %, preferably 1 to 200 mol %, most preferably 5 to 150 mol % based on 1 mole of couplers to be used.

The compounds of the general formulae (A) to (D) are particularly preferably co-emulsified with a coupler represented by the general formulae (I) or (II).

The compounds of the general formulae (A) to (D) may be used in combination with known discoloration inhibitors. In this case, the effect of inhibiting discoloration can be further improved. Similarly, two or more of the compounds of the present invention represented by the general formulae (A) to (D) may be used in combination. In particular, the combination of a compound of the general formula (A), (B), or (C) to (C) with a compound of the general formula (D) markedly reduces cyan stains and thus is preferred.

Typical examples of such known discoloration inhibitors include hydroquinones, 6-hydroxychromans, 5-hydroxycoumarans, spirochromans, hindered phenols such as p-alkoxyphenols and bisphenols, gallic acid derivatives, methylenedioxybenzenes, aminophenols, hindered amines, ultraviolet absorbents, and ether or ester derivatives obtained by silylating or alkylating the phenolic hydroxyl group in these compounds. Further, metal complexes such as (bissalicylaldoximate)nickel complexes and (bis-N,N-dialkyldithiocarbamate)nickel complexes may be used.

Specific examples of organic discoloration inhibitors include hydroquinones as disclosed in U.S. Pat. Nos. 2,360,290, 2,418,613, 2,700,453, 2,701,197, 2,728,659, 2,732,300, 2,735,765, 3,982,944, 4,430,425, 2,710,801, and 2,816,028, and British Patent 1,363,921, 6-hydroxychromans, 5-hydroxychromans and spirochromans as disclosed in U.S. Pat. Nos. 3,432,300, 3,573,050, 3,574,627, 3,698,909, and 3,764,337, and JP-A-52-152225, spiroindans as disclosed in U.S. Pat. No. 4,360,589, p-alkoxyphenols as disclosed in U.S. Pat. No. 2,735,765, British Patent 2,066,975, JP-A-59-10539, and JP-B-57-19765 (the term "JP-B" as used herein means an "examined published Japanese patent publication", hindered phenols as disclosed in U.S. Pat. Nos. 3,700,455, and 4,228,235, JP-A-52-72224, and JP-B-52-6623, gallic acid derivatives as disclosed in U.S. Pat. No. 3,457,079, methylenedioxybenzenes as disclosed in U.S. Pat. Nos. 4,332,886, aminophenols as disclosed in JP-B-56-21144, hindered amines as disclosed in U.S. Pat. Nos. 3,336,135, and 4,268,593, British Patents 1,326,889, 1,354,313, and 1,410,846, JP-B-51-1420, and JP-A-58-114036, 59-53846, and 59-78344, and metal complexes as disclosed in U.S. Pat. Nos. 4,050,938, and 4,241,155, and British Patent 2,027,731 (A).

The light-sensitive material of the present invention may comprise at least one layer containing a cyan coupler of the present invention and an lipophilic compound of the present invention on a support. Such a layer may be a hydrophilic colloidal layer on a support. In general, the light-sensitive material may comprise at least one blue-sensitive silver halide emulsion layer, at least one green-sensitive silver halide emulsion layer and at least red-sensitive silver halide emulsion layer coated on a support in this order. The order of the arrangement of these color-sensitive silver halide emulsion layers may vary. An infrared-sensitive silver halide emulsion layer may be substituted for at least one of the above mentioned light-sensitive emulsion layers. These light-sensitive emulsion layers can comprise silver halide emulsions sensitive to the corresponding wavelength ranges and color couplers which form dyes complementary to the light to which the silver halide emulsions are sensitive to reproduce a color image in the subtractive process. However, these light-sensitive emulsion layers and the color hue of color couplers may not have the above mentioned correspondence.

In the case where a cyan coupler of the present invention and an lipophilic compound of the present invention are applied to the light-sensitive material, they are particularly preferably applied to the red-sensitive silver halide emulsion layer.

The content of the cyan coupler of the present invention is preferably in the range of $1\times10^{-3}$ to 1 mole, more preferably $2\times10^{-3}$ to $3\times10^{-1}$ mole per mole of silver halide.

The incorporation of the cyan coupler of the present invention and the lipophilic compound of the present invention in the light-sensitive material can be accomplished by various known dispersion methods. In particular, an oil-in-water dispersion method by which the cyan coupler and lipophilic compound are dissolved in a high boiling organic solvent (optionally in combination with a low boiling organic solvent), emulsion-dispersed in an aqueous solution of gelatin, and then incorporated in a silver halide emulsion is preferrred.

Examples of high boiling solvents to be used in the oil-in-water dispersion method are disclosed in, for example, U.S. Pat. No. 2,322,027. Specific examples of processes and effects of the latex dispersion method as one of the polymer dispersion methods and latexes to be used in dipping are disclosed in U.S. Pat. No. 4,199,363, West German Patent Application (OLS) 2,541,274, and 2,541,230, JP-B-53-41091, and European Patent 029104. The dispersion method with an organic solvent-soluble polymer is described in PCT International Disclosure No. W088/00723.

Examples of high boiling organic solvents which can be used in the above mentioned oil-in-water dispersion method include ester phthalates (e.g., dibutyl phthalate, dioctyl phthalate, dicyclohexyl phthalate, di-2-ethylhexyl phthalate, decyl phthalate, bis(2,4-di-tert-amylphenyl)isophthalate, bis(1,1-diethylpropyl)phthalate), ester phosphates (e.g., diphenyl phosphate, triphenyl phosphate, tricresyl phosphate, 2-ethylhexyl diphenyl phosphate, dioctylbutyl phosphate, tricyclohexyl phosphate, tri-2-ethylhexyl phosphate, tridecyl phosphate, di-2-ethylhexylphenyl phosphate), ester benzoates (e.g., 2-ethylhexyl benzoate, 2,4-dichlorobenzoate, dodecyl benzoate, 2-ethylhexyl-p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanate, tributyl citrate, diethyl azerate, isostearyl lactate, trioctyl citrate), aniline derivatives (e.g., N,N-dibutyl-2-butoxy-5-tert-octylaniline), chlorinated paraffins (e.g., paraffins having a chlorine content of 10% to 80%), ester trimesicates (e.g., tributyl trimesicate), dodecyl benzene, diisopropyl naphthalene, phenols (e.g., 2,4-di-tertamylphenol, 4-dodecyloxyphenol, 4-dodecyloxycarbonylphenol, 4-(4-dodecyloxyphenylsulfonyl)phenol), carboxylic acids (e.g., 2-(2,4-di-tert-amylphenoxybutyric acid, 2-ethoxyoctanedecanic acid), and alkylphosphoric acids (e.g., di-2(ethylhexyl)-phosphoric acid, diphenylphosphoric acid). As auxiliary solvents to be used in combination with these high boiling solvents there may be used organic solvents having a boiling point of 30° C. to about 160° C. (e.g., ethyl acetate, butyl acetate, ethyl propionate, methyl ethyl ketone, cyclohexanone, 2-ethoxyethyl acetate, dimethyl formamide).

Such a high boiling organic solvent may be used in an amount of 0 to 2.0 times, preferably 0 to 1.0 time the weight of the coupler to be used in combination therewith.

As silver halide emulsions and other materials (e.g., additive) and photographic constituting layers (e.g., layer arrangement) to be used in the present invention and processing methods and processing additives to be used in the processing of the light-sensitive material there can be preferably used those disclosed in the following patents, particularly EP0,355,660A.

| Photographic constituent, etc. | JP-A-62-215272 | JP-A-2-33144 | EP0,355,660A2 |
|---|---|---|---|
| Silver halide emulsion | Line 6, upper right column, p. 10 - line 5, lower left column, p. 12/last line 4, lower right column, p. 12 - line 17, upper left column, p. 13 | Line 16, upper right column, p. 28 - line 11, lower right column, p. 29/line 2–line 5, p. 30 | Line 53, p. 45 - line 3, p. 47/line 20 - line 22, p. 47 |
| Silver halide solvent | Line 6–line 14, lower left column, p. 12/last line 3, upper left column, p. 13 - last line, lower left column, p. 18 | — | — |
| Chemical sensitizer | Last line 3, lower left column, p. 12 - last line 5, lower right column, p. 12/line 1, lower right column, p. 18 - last line 9, upper right column, p. 22 | Line 12 - last line, lower right column, p. 29 | Line 4–line 9, p. 47 |
| Spectral sensitizer (spectral sensitizing method) | Last line 8, upper right column, p. 22 - last line, p. 38 | Line 1–line 13, upper left line, p. 30 | Line 10–line 15, p. 47 |
| Emulsion stabilizer | Line 1, upper left column, p. 39 - last line, upper right column, p. 72 | Line 14, upper left column - line 1, upper right column, p. 30 | Line 16–line 19, p. 47 |
| Development accelerator | Line 1, lower left column, p. 72 - line 3, upper right column, p. 91 | — | — |
| Color coupler (cyan, magenta, yellow coupler) | Line 4, upper right column, p. 91 - line 6, upper left column, p. 121 | Line 14, upper right column, p. 3 - last line, upper left column, p. 18/line 6, upper right column, 45 - line p. 30 - line 11, lower right column, p. 35 | Line 15–line 27, p. 4/line 30, p. 5 - last line, p. 28/line 29, p. 45/line 31, p. 45/line 23, p. 47 - line 50, p. 63 |
| Color intensifier | Line 7, upper left column, p. 121 - line 1, upper right column, p. 125 | — | — |
| Ultraviolet absorbent | Line 2, upper right column, p. 125 - last line, lower left column, p. 127 | Line 14, lower left column, p. 37 - line 11, upper left column, p. 38 | Line 22–line 31, p. 65 |
| Discoloration inhibitor (image stabilizer) | Line 1, upper right column, p. 127 - line 8, lower left column, p. 137 | Line 12, upper right column, p. 36 - line 19, upper left column, p. 37 | Line 30, p. 4 - line 23, p. 5/line 1, p. 29 - line 25, p. 45/line 33–line 40, p. 45/line 2–line 21, p. 65 |
| High boiling and/or low boiling organic solvent | Line 9, lower left column, column, p. 137 - last line, right column, p. 144 | Line 14, lower right column, p. 35 - line 4, upper left column, p. 4 | Line 1–line 51, p. 64 |

-continued

| Photographic constituent, etc. | JP-A-62-215272 | JP-A-2-33144 | EP0,355,660A2 |
|---|---|---|---|
| Method for dispersing photographic additives | Line 1, upper left column, p. 144 - line 7, upper right column, p. 146 | Line 10, lower right column, p. 27 - last line, upper left column, p. 28/line 12, lower right column, p. 35 - line 7, upper right column, p. 36 | Line 51, p. 63 - line 56, p. 64 |
| Film hardener | Line 8, upper right column, p. 146 - line 4, lower left column p. 155 | — | — |
| Developing agent precursor | Line 5, lower left column, p. 155 - line 2, lower right column, p. 155 | — | — |
| Development inhibitor-releasing compound | Line 3–line 9, lower right column, p. 155 | — | — |
| Support | Line 19, lower right column, p. 155 - line 14, upper left column, p. 156 | Line 18, upper right column, p. 38 - line 3, upper left column, p. 39 | Line 29, p. 66 - line 13, p. 67 |
| Structure of light-sensitive layer | Line 15, upper left column, p. 156 - line 14, lower left column, p. 156 | Line 1–line 15, upper right column, p. 28 | Line 41–line 52, p. 45 |
| Dye | Line 15, lower right column, p. 156 - last line, lower right column, p. 184 | Line 12, upper left column - line 7, upper right column, p. 38 | Line 18–line 22, p. 66 |
| Color stain inhibitor | Line 1, upper left column, p. 185 - line 3, lower right column, p. 188 | Line 8–line 11, upper right column, p. 36 | Line 57, p. 64 - line 1, p. 65 |
| Gradation adjustor | Line 4–line 8, lower right column, p. 188 | — | — |
| Stain inhibitor | Line 9, lower left column, p. 201 - last line, upper right column, p. 210 | Line 1, upper right column, p. 18 - last line, lower right column, p. 24/last line 10, lower left column, p. 27 - line 9, lower right column, p. 10 | — |
| Fluorine containing compound (antistatic agent, coating aid, lubricant, adhesion inhibitor) | Line 1, lower left column, p. 210 - line 5, lower left column, p. 222 | Line 1, upper left column, p. 25 - line 9, lower right column, p. 27 | — |
| Binder (hydrophilic colloid) | Line 6, lower left column, p. 222 - last line, upper left column, p. 225 | Line 8–line 18, upper left column, p. 38 — | Line 23–line 28, p. 66 |
| Thickening agent | Line 1, upper right column, p. 225 - line 2, upper right column, p. 227 | — | — |
| Antistatic agent | Line 3, upper right column, p. 227 - line 1, upper left column, p. 230 | — | — |
| Polymer latex | Line 2, upper left column, p. 230 - last line, p. 239 | — | — |
| Matting agent | Line 1, upper left column, p. 240 - last line, upper right column, p. 240 | — | — |
| Photographic processing method (processing step, additive) | Line 7, upper right column, p. 3 - line 5, upper right column, p. 10 | Line 4, upper left column, p. 39 - last line, upper left column, p. 42 | Line 14, p. 67 - line 28, p. 69 |

(Note) The contents cited in JP-A-62-215272 include the contents described in the written amendment of procedure dated March 16, 1987 attached thereto. Among the above mentioned color couplers, as yellow couplers there may also be preferably used the so-called short wave type yellow couplers as disclosed in JP-A-63-231451, 63-123047, 63-241547, 1-173499, 1-213648, and 1-250944.

As the silver halide to be used in the present invention there can be used silver chloride, silver bromide, silver bromochloride, silver bromochloroiodide, silver bromoiodide, etc. In particular, for the purpose of rapid processing, a silver bromochloride emulsion substantially free of silver iodide and having a silver chloride content of 90 mol % or more, preferably 95 mol % or more, particularly 98 mol % or more or a pure silver chloride emulsion is preferably used.

For the purpose of improving the sharpness of the image, the light-sensitive material of the present invention comprises a dye (particularly as oxonol dye) discolorable by processing as disclosed in EP0,337,490A2, pp. 27–76, in the hydrophilic colloidal layer in an amount such that the chemical reflection density of the light-sensitive material at 680 nm reaches 0.70 or more or titanium oxided surface-treated with a dihydric, trihydric or tetrahydric alcohol (e.g., trimethytolethane) in the water-resistant resin layer in the support in an amount of 12% by weight or more, preferably 14% by weight or more.

The light-sensitive material of the present invention preferably comprises a dye preservability improving compound as disclosed in EP0,277,589A2 in combination with the above mentioned couplers, particularly with pyrazoloazole magenta couplers.

That is, Compound (F) which undergoes chemical bonding to an aromatic amine developing agent remaining after color development to produce a chemically inert and substantially colorless compound and/or Compound (G) which undergoes chemical bonding to an oxidation product of an aromatic amine developing agent remaining after color development to produce a chemically inert and substantially colorless compound are preferably used singly or in combination, e.g., to inhibit the occurence of stain and other side effects caused by the production of developed dyes by the reaction of a color developing agent or oxidation product thereof remaining in the film during the storage after processing.

The light-sensitive material of the present invention may preferably comprise an antimold as disclosed in JP-A-63-271247 to inhibit the proliferation of various molds and bacteria in the hydrophilic colloidal layer that deteriorates images.

As the support to be used for the light-sensitive material of the present invention there can be used a white polyester support for display or a support comprising a white pigment-containing layer provided on the side having the silver halide emulsion layer. In order to further improve the sharpness of images, an antihalation layer may be preferably coated on the silver halide emulsion layer side of the support or the other side thereof. In particular, the transmission density of the support is preferably set to 0.35 to 0.8 to make display viewable on both reflected light and transmitted light.

The light-sensitive material of the present invention may be exposed to either visible light or infrared rays. In the exposure process, either low intensity exposure or high intensity-short time exposure may be used. In the latter case, a laser scanning exposure process in which the exposure time per pictures element is less than $10^{-4}$ seconds is desirable.

In the exposure process, a band stop filter as disclosed in U.S. Pat. No. 4,880,726 is preferably used. With such a band stop filter, light color stain can be removed, remarkably improving color reproducibility.

The present invention can be applied to color paper, color reversal paper, direct positive color light-sensitive material, color negative film, color positive film, color reversal film, etc. In particular, the present invention is preferably applied to a color fight-sensitive material comprising a reflective support (e.g., color paper, color reversal paper) or color light-sensitive material for forming a positive image (e.g., direct positive color light-sensitive material, color positive film, color reversal film), particularly color light-sensitive material comprising a reflective support.

In order to effect the present invention, a magenta coupler which undergoes coupling with an oxidation product of an aromatic primary amine color developing agent to develop magenta and a yellow coupler which undergoes coupling with an oxidation product of an aromatic primary amine color developing agent to develop yellow are preferably used in combination. Further, these couplers are preferably used in combination with known phenolic or naphtholic cyan couplers as necessary.

The couplers to be used in combination may be two-equivalent or four-equivalent to silver ion. These couplers may be in the form of polymer or oligomer. The couplers to be used in combination each may be a single kind of a coupler or a mixture of two or more kinds of couplers.

Couplers which can be preferably used in combination with the cyan coupler of the present invention in the present invention will be described hereinafter.

As cyan couplers to be used in combination with the cyan coupler of the present invention there can be used phenolic and naphtholic couplers. Preferred examples of such cyan couplers include those described in U.S. Pat. Nos. 4,052,212, 4,146,396, 4,228,233, 4,296,200, 2,369,929, 2,801,171, 2,772,162, 2,895,824, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Disclosure No. 3,329,729, European Patents 121,365A and 249,453A, and JP-A-61-42658. Further, pyrazoloazole couplers as disclosed in JP-A-64-553, 64-554, 64-555, and 64-556 and imidazolic couplers as disclosed in U.S. Pat. No. 4,818,672 can be used in combination with the cyan coupler of the present invention.

Particularly preferred cyan couplers are couplers represented by the general formulae (C-I) and (C-II) described in JP-A-2-139544, lower left column on page 17–lower left column on page 20. These cyan couplers may be incorporated in the same layer as the cyan coupler of the present invention or in a different layer in an amount such that the effects of the present invention can be exerted.

As magenta couplers to be used in combination with the cyan coupler of the present invention there can be used 5-pyrazolone and pyrazoloazole compounds. Preferred examples of such compounds include those described in U.S. Pat. Nos. 4,310,619, 4,351,897, 3,061,432, 3,725,067, 4,500,630, 4,540,654, and 4,556,630, European Patent 73,636, Research Disclosure Nos. 24220 (June 1984) and 24230 (June 1984), JP-Disclosure A-60-43659, 61-72238, 60-35730, 55-118034, and 60-185951, and International Patent Disclosure W088/04795.

Particularly preferred magenta couplers are pyrazoloazole magenta couplers represented by the general formula (I) as disclosed in JP-A-2-139544, lower right column on page 3 to lower right column on page 10, and 5-pyrazolone magenta couplers represented by the general formula (M-1) as disclosed in JP-A-2-139544, lower left column on page 17 to upper left column on page 21. Most preferred among these magenta couplers are the above mentioned pyrazoloazole magenta couplers.

As yellow couplers to be used in combination with the cyan coupler of the present invention there can be used those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020, and 1,476,760, European Patent 249,473, and JP-A-63-23145, 63-123047, 1-250944, and 1-213648 so far as they do not inhibit the effects of the present invention.

Particularly preferred yellow couplers are yellow couplers represented by the general formula (Y) as described in JP-A-2-139544, upper left column on page 18 to lower left column on page 22, acylacetamide yellow couplers characterized by an acyl group as described in European Patent Disclosure No. 0447969, and yellow couplers represented by the general formula (Cp-2) as described in European Patent Disclosure No. 0446863A2.

Couplers which release a photographically useful residue upon coupling can also be used in the present invention. Preferred examples of DIR couplers which release a development inhibitor include those described in patents cited in RD No. 17643, VII - F, JP-A-57-151944, 57-154234, 60-184248, and 63-37346, and U.S. Pat. Nos. 4,248,962, and 4,782,012.

As couplers which release a nucleating agent or development accelerator imagewise during development there can be preferably used those described in British Patents 2,097,140, and 2,131,188, and JP-A-59-157638, and 59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound-releasing couplers, DIR coupler-releasing couplers, DIR coupler-releasing redox compounds or DIR redox-releasing redox compounds as described in JP-A-60-185950 and 62-24252, couplers capable of releasing a dye which returns to its original color after release as described in European Patents 173,302A, bleach accelerator-releasing couplers as described in RD Nos. 11449, 24241, and JP-A-61-201247, ligand-releasing couplers as described in U.S. Pat. No. 4,553,477, leuco dye-releasing couplers as described in JP-A-63-75747, and fluorescent dye-releasing couplers as described in U.S. Pat. No. 4,774,181.

The standard amount of these color couplers to be used in combination with the cyan coupler of the present invention is in the range of 0.001 to 1 mole per mole of light-sensitive silver halide. In particular, the amounts of yellow coupler, magenta coupler and cyan coupler to be used are preferably in the range of 0.01 to 0.5 mole, 0.003 to 0.3 mole and 0.002 to 0.3 mole per mole of light-sensitive silver halide, respectively.

The light-sensitive material of the present invention may comprise a hydroquinone derivative, aminophenol derivative, gallic acid derivative, ascorbic acid derivative, etc. as a color fog inhibitor.

In order to inhibit the deterioration of a cyan dye image due to heat, particularly due to light, it is further effective to incorporate an ultraviolet absorbent in the cyan color layer and both adjacent layers.

As such an ultraviolet absorbent there can be used a benzotriazole compound substituted by an aryl group as disclosed in U.S. Pat. No. 3,533,794, a 4-thiazolidone compound as disclosed in U.S. Pat. Nos. 3,314,794, and 3,352,681, a benzophenone compound as disclosed in JP-A-46-2784, a cinnamic ester compound as disclosed in U.S. Pat. Nos. 3,705,805 and 3,707,395, a butadiene compound as disclosed in U.S. Pat. No. 4,045,229, or a benzoxazole compound as disclosed in U.S. Pat. No. 3,406,070, and 4,271,307. Further, ultraviolet-absorbing couplers (e.g., α-naphtholic cyan dyeforming couplers) or ultraviolet-absorbing polymers may be used. These ultraviolet absorbents may be mordanted in specific layers. Particularly preferred among these ultraviolet absorbents are the above mentioned benzotriazole compounds Substituted by an aryl group.

The light-sensitive material according to the present invention can be developed by ordinary methods as described in the above cited RD Nos. 17643, pp. 28–29, and 18716, left column to right column on page 615. For example, color development, desilvering, and rinsing are conducted. In the desilvering process, a blix process with a blix solution can be conducted instead of a bleach process with a bleaching solution and a fixing process with a fixing solution. The bleach process, fixing process and blix process can be conducted in any order. Stabilizing may be conducted instead of or after rinsing. Alternatively, a monobath processing process in which color development, bleach and fixing are conducted in a single bath with a combined developing, bleaching and fixing solution can be used. In combination with these processing steps, a pre-hardening step, its neutralizing step, a stop-fixing step, an after-hardening step, an adjusting step, and an intensification step may be effected. An intermediate rinsing step may be arbitrarily provided between these steps. In these steps, the so-called activator processing step may be substituted for the color development step.

The present invention will be further described hereinafter by referrence to specific examples, but the present invention should not be construed as being limited thereto.

EXAMPLE 1

A polyethylene double-laminated paper support was subjected to corona discharge. On the surface of the support was then coated a gelatin subbing layer containing sodium dodecylbenzenesulfonate. Further, various photographic constituent layers were coated on the subbing layer to prepare a multilayer color photographic paper having the following layer structure (Specimen 101). The various coating solutions were prepared as follows:

Preparation of 1st Layer Coating Solution 153.0 g of a yellow coupler (ExY), 15.0 g of a dye image stabilizer (Cpd-1), 7.5 g of a dye image stabilizer (Cpd-2), and 16.0 g of a dye image stabilizer (Cpd-3) were dissolved in 25 g of a solvent (Solv-1), 25 g of a solvent (Solv-2) and 180 cc of ethyl acetate. This solution was then emulsion-dispersed in 1,000 g of a 10% aqueous solution of gelatin containing 60 cc of 10% sodium dodecylbenzenesulfonate and 10 g of citric acid to prepare an emulsion dispersion A.

On the other hand, a silver bromochloride emulsion A (3:7 (molar ratio in terms of silver content) mixture of a large grain size emulsion A of cubic grains having an average size of 0.88 μm and a grain size distribution fluctuation coefficient of 0.08 and a small grain size emulsion A of cubic grains having an average size of 0.70 μm and a grain size distribution fluctuation coefficient of 0.10, both comprising 0.3 mol % of silver bromide partially localized on the surface of grains) was prepared. This emulsion comprised blue-sensitive sensitizing dyes A and B described later in an amount of $2.0\times10^{-4}$ mole each for large grain size emulsion A and $2.5\times10^{-4}$ mole each for small grain size emulsion A. The chemical ripening of the emulsion was accomplished with a sulfur sensitizer and a gold sensitizer.

The above mentioned emulsion dispersion A and the silver bromochloride emulsion A were mixed to make a coating solution for the 1st layer having the formulation set forth below.

Preparation of 5th Layer Coating Solution 26.0 g of a cyan coupler (ExC), 18.0 g of an ultraviolet absorbent (UV-2), 30.0 g of a dye image stabilizer (Cpd-1), 10.0 g of a dye image stabilizer (Cpd-9), 10.0 g of a dye image stabilizer (Cpd-10), and 1.0 g of a dye image stabilizer (Cpd-11) were dissolved in 20.0 g of a solvent (Solv-6), 1.0 g of a solvent (Solv-1) and 60 cc of ethyl acetate. This solution was then added to 500 cc of a 20% aqueous solution of gelatin containing 8 cc of sodium dodecylbenzenesulfonate. The mixture was then subjected to emulsion dispersion by means of an ultrasonic homogenizer to prepare an emulsion dispersion C.

On the other hand, a silver bromochloride emulsion C (1:4 (molar ratio in terms of silver content) mixture of a large grain size emulsion C of cubic grains having an average size of 0.50 μm and a grain size distribution fluctuation coefficient of 0.09 and a small grain size emulsion C of cubic grains having an average size of 0 41 μm and a grain size distribution fluctuation coefficient of 0.11, both comprising 0.8 mole % of silver bromide partially localized on the surface of grains) was prepared. This emulsion C comprised a red-sensitive sensitizing dye C described later in an amount of $0.9\times10^{-4}$ mole for large size emulsion C and $1.1\times10^{-4}$ mole for small size emulsion C. Compound F shown later was contained in emulsion C in an amount of $2.6\times10^{-3}$ mole per mole of silver halide. The chemical ripening of the emulsion was accomplished with a sulfur sensitizer and a gold sensitizer.

The above mentioned emulsion dispersion C and the red-sensitive silver bromochloride emulsion C were mixed to make a coating solution for the 5th layer having the formulation set forth below.

The coating solutions for the 2nd to 4th layer and the 6th and 7th layers were prepared in the same manner as for the 1st layer. As gelatin hardener for each layer there was used sodium salt of 1-oxy-3,5-dichloro-s-triazine.

To each of these layers were added preservatives Cpd-14 and Cpd-15 in amounts of 25.0 mg/m$^2$ and 50.0 mg/m$^2$, respectively.

Spectral sensitizing dyes to be used for the silver bromochloride emulsion in each light-sensitive emulsion layer are set forth below.

Blue-sensitive emulsion layer

Sensitizing dye A

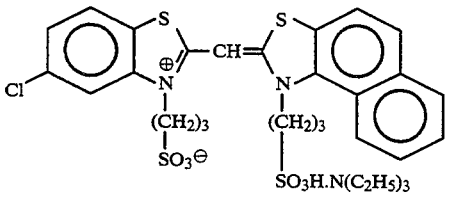

and

Sensitizing dye B

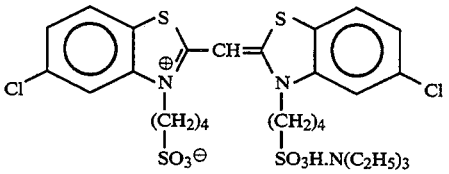

Sensitizing dye C

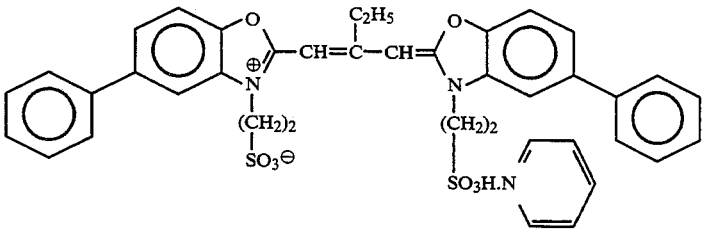

($4.0\times10^{-4}$ mole for large grain size emulsion B (described later) per mol of silver halide and $5.6\times10^{-4}$ mole for small grain size emulsion B (described later) per mole of silver halide Sensitizing Dye D -continued

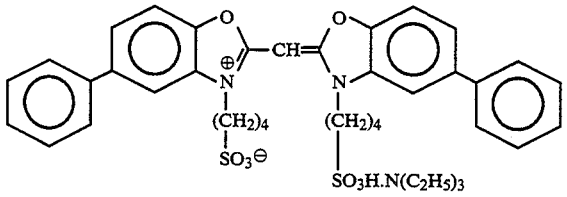

($7.0\times10^{-5}$ mole for large grain size emulsion B per mole of silver halide and $1.0\times10^{-5}$ mole for small grain size emulsion B per mole of silver halide)

Red-sensitive emulsion layer

Sensitizing dye E

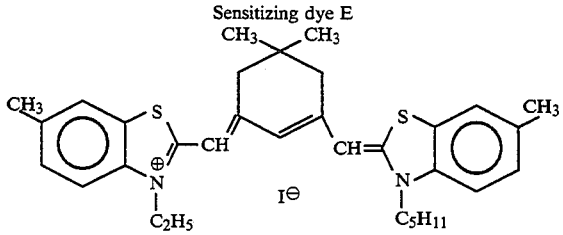

Compound F

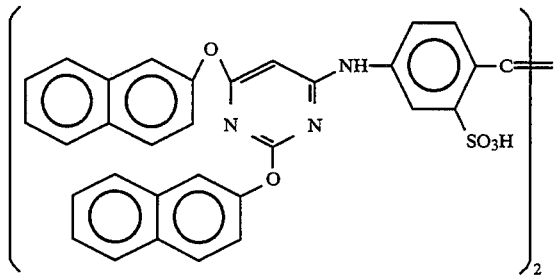

To the blue-sensitive emulsion layer, green-sensitive emulsion layer and red-sensitive emulsion layer was added 1-(5-methylureidephenyl)-5-mercaptotetrazole in an amount of $8.5\times10^{-5}$ mole, $7.7\times10^{-4}$ mole and $2.5\times10^{-4}$ mole per mole of silver halide, respectively.

Further, to the blue-sensitive emulsion layer and green-sensitive emulsion layer was added 4-hydroxy-6-methyl-1,3,3a,7-tetrazaindene in an amount of $1\times10^{-4}$ mole and $2\times10^{-4}$ mole per mole of silver halide, respectively.

For the purpose of inhibiting irradiation, to the emulsion layer were added the following dyes (the figure in the parenthesis indicate the coated amount):

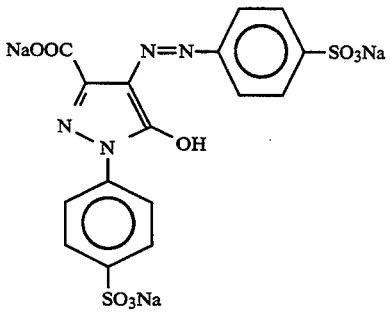

(10 mg/m²)

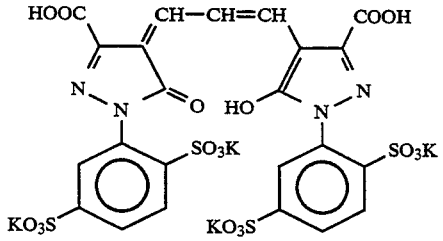

(10 mg/m²)

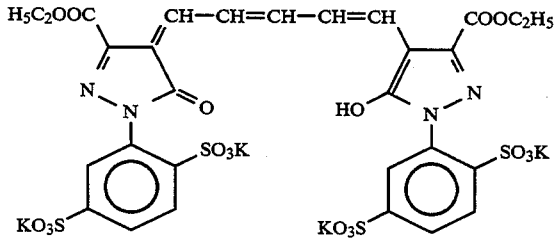

(40 mg/m²)

and

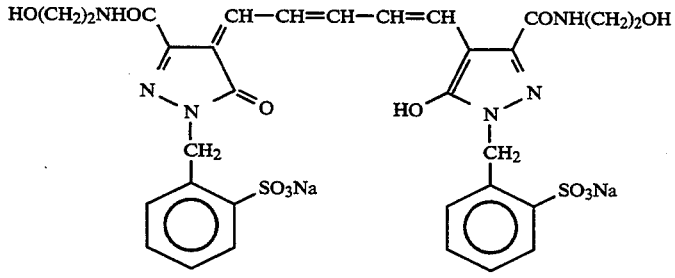

(20 mg/m²)

Layer Arrangement

The compositions of the various layers are set forth below. The figure indicates the coated amount (g/m²). The coated amount of silver halide emulsion is represented as calculated in terms of silver.

| | |
|---|---|
| Support: | |
| Polyethylene-laminated paper [containing a white pigment ($TiO_2$) and a bluish dye (ultramarine) in polethylene on the 1st layer side] | |
| 1st layer (blue-sensitive yellow coloring layer): | |
| Silver bromochloride emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| 2nd layer (color stain inhibiting layer): | |
| Gelatin | 1.00 |
| Color stain inhibitor (Cpd-4) | 0.06 |
| Solvent (Solv-7) | 0.03 |
| Solvent (Solv-2) | 0.25 |
| Solvent (Solv-3) | 0.25 |
| 3rd layer (green-sensitive emulsion layer): | |
| Silver bromochloride emulsion (1:3 (Ag molar ratio) mixture of a large grain size emulsion B | 0.13 |

-continued

| | |
|---|---|
| comprising cubic grains with an average size of 0.55 μm and a grain size fluctuation coefficient of 0.10 and a small grain size emulsion B comprising cubic grains with an average size of 0.39 μm and a grain size flutuation coefficient of 0.08; both emulsions comprising 0.8 mole % of AgBr localized partially on the surface of grains) | |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| 4th layer (color stain inhibiting layer) | |
| Gelatin | 0.70 |
| Color stain inhibitor (Cpd-4) | 0.04 |
| Solvent (Solv-7) | 0.02 |
| Solvent (Solv-2) | 0.18 |
| Solvent (Solv-3) | 0.18 |
| 5th layer (red-sensitive emulsion layer): | |
| Silver bromochloride emulsion C | 0.17 |
| Gelatin | 0.85 |
| Cyan coupler (ExC) | 0.26 |
| Ultraviolet absorbent (UV-2) | 0.18 |
| Dye image stabilizer (Cpd-1) | 0.30 |
| Dye image stabilizer (Cpd-9) | 0.10 |
| Dye image stabilizer (Cpd-10) | 0.10 |
| Dye image stabilizer (Cpd-11) | 0.01 |
| Solvent (Solv-6) | 0.20 |
| Solvent (Solv-1) | 0.01 |
| 6th layer (ultraviolet absorbing layer): | |
| Gelatin | 0.55 |
| Ultraviolet absorbent (UV-1) | 0.38 |
| Dye image stabilizer (Cpd-12) | 0.15 |
| Dye image stabilizer (Cpd-5) | 0.02 |
| 7th layer (protective layer): | |
| Gelatin | 1.13 |
| Acryl-modified copolymer of polyvinyl alcohol (modification degree: 17%) | 0.05 |
| Liquid paraffin | 0.02 |
| Dye image stabilizer (Cpd-13) | 0.01 |

Yellow coupler (ExY)
1:1 (molar ratio) mixture of:

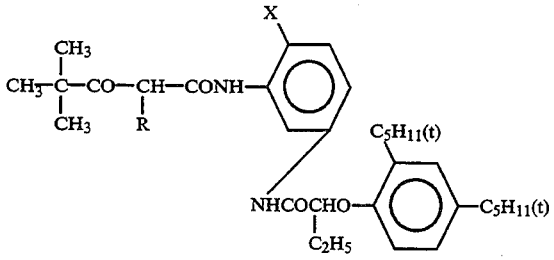

wherein R is

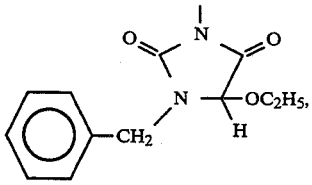

X = Cl and

-continued wherein R is

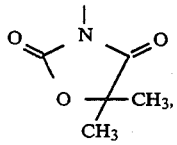

X = $OCH_3$

Magenta coupler (ExM)

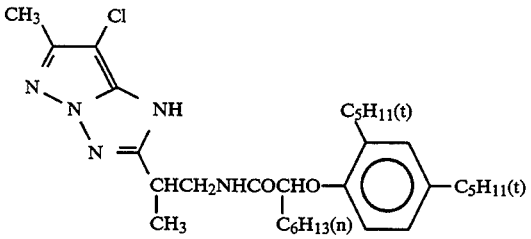

Cyan coupler (ExC)
3:7 (molar ratio) of:

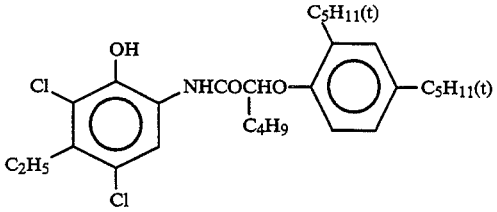

and

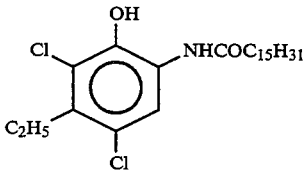

Dye image stabilizer (Cpd-1)

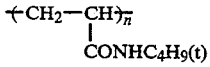

Average molecular weight: 60,000

Dye image stabilizer (Cpd-2)

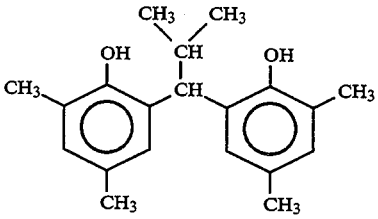

Dye image stabilizer (Cpd-3)

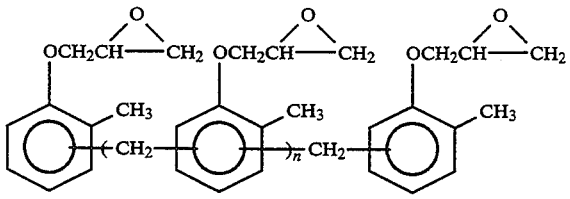

n = 7 to 8

Color stain inhibitor (Cpd-4)

-continued
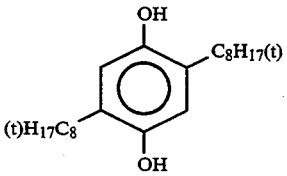
Dye image stabilizer (Cpd-5)
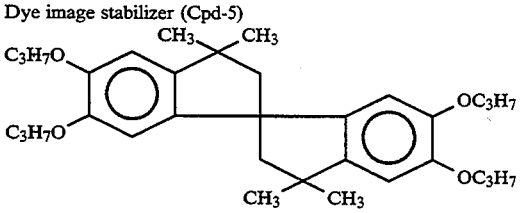
(Cpd-6)
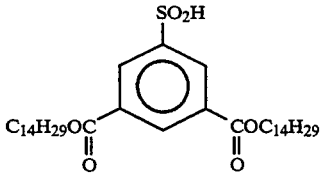
(Cpd-7)
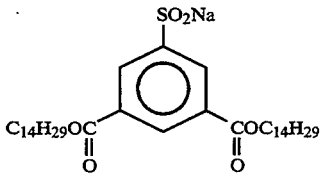
Dye image stabilizer (Cpd-8)
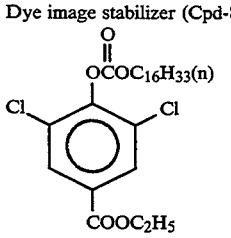
Dye image stabilizer (Cpd-9)
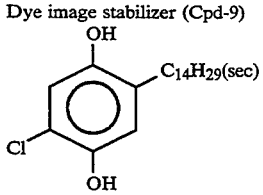
Dye image stabilizer (Cpd-10)
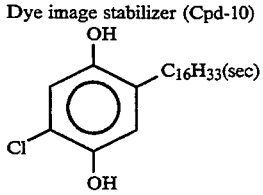
(Cpd-11)
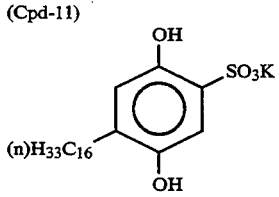
-continued
(Cpd-12)
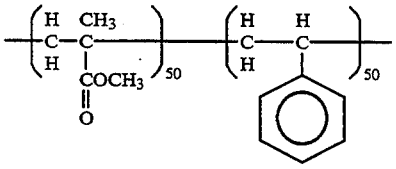
Average molecular weight: 6,000
(Cpd-13)
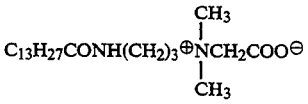
Preservative (Cpd-14)
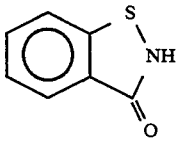
Preservative (Cpd-15)
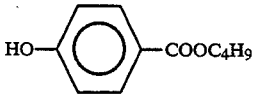
Ultraviolet absorbent (UV-1)
10:5:1:5 (weight ratio) of:
(1)
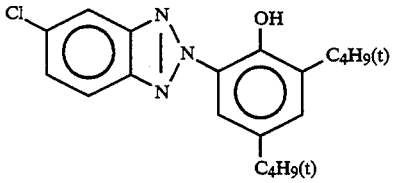
(2)
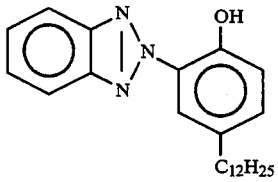
(3)
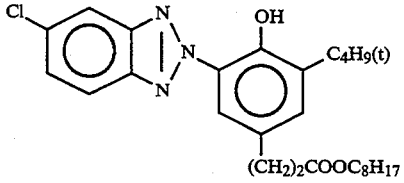
(4)
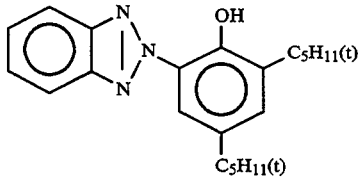
Ultraviolet absorbent (UV-2)
1:2:2 (weight ratio) mixture of:

-continued
(1)
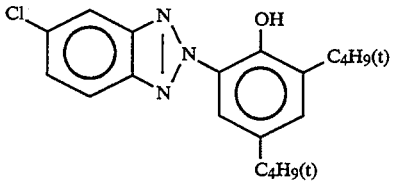
(2)
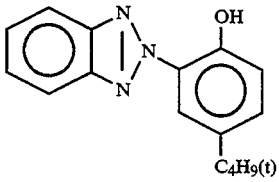
(3)
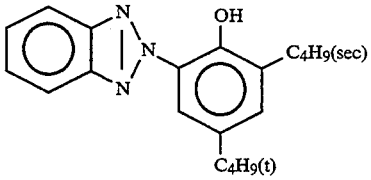
Solvent (Solv-1)
$C_8H_{17}CHCH(CH_2)_7COOC_8H_{17}$
$\quad\quad\quad

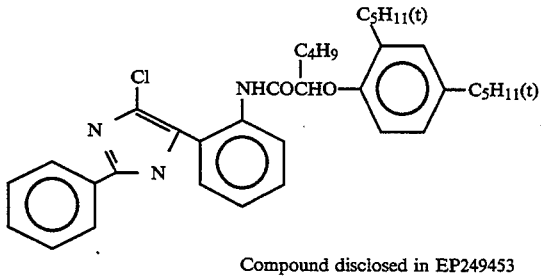

R-1

Compound disclosed in EP249453

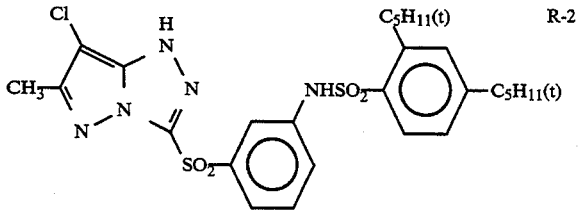

R-2

Compound disclosed in U.S. Pat. No. 4,873,183

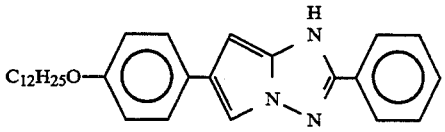

M-1

Compound disclosed in JP-A-62-279340

Specimens 102 to 164 were prepared in the same manner as Specimen 101 except that the cyan coupler (ExC) to be incorporated in the 5th layer was replaced by the comparative couplers and the couplers of the present invention in the eguimolecular amounts, respectively, and lipophilic additives of the present invention set forth in Table A were added thereto. In Specimens 118 to 121, the magenta coupler (ExM) to be incorporated in the 3rd layer was replaced by M-1 in the equimolecular amount and lipophilic additives set forth in Table A were added thereto. The added amount of additives was represented by wt. %.

These specimens were subjected to exposure of three color separation, subjected to the above mentioned running processing, and then measured for density on the cyan-colored portion with red light. From a sensitometry curve obtained, the cyan maximum color density Dmax and the cyan fog density Dmin (Fr) were read. These processed specimens were stored at a temperature of 60° C. and a relative humidity of 70% for 3 days. These specimens were then measured for cyan density again. The density on the fogged portion was defined as Dmin (60° C., 70%, 3d). The results are set forth in Table A. Specimens 118 to 121 were measured for density on the magenta-colored portion with green light. The magenta maximum color density and the magenta fog density were then read.

TABLE A

| Specimen | | Additive of the present invention | | Maximum color density | Fog density Dmin | | |
|---|---|---|---|---|---|---|---|
| No. | Coupler | Kind | Amount | Dmax | Fr | 60° C., 70%, 3d | Remarks |
| 101 | ExC | — | — | 1.72 | 0.11 | 0.11 | Comparative |
| 102 | R-1 | — | — | 1.48 | 0.16 | 0.15 | " |
| 103 | " | ST-2 | 20% | 1.45 | 0.15 | 0.14 | " |
| 104 | " | " | 50% | 1.32 | 0.16 | 0.14 | " |
| 105 | " | " | 100% | 1.13 | 0.18 | 0.16 | " |
| 106 | " | ST-4 | 50% | 1.36 | 0.16 | 0.15 | " |
| 107 | " | ST-30 | " | 1.31 | 0.17 | 0.16 | " |
| 108 | " | ST-51 | " | 1.27 | 0.16 | 0.15 | " |
| 109 | " | ST-56 | " | 1.33 | 0.16 | 0.14 | " |
| 110 | R-2 | — | — | 1.21 | 0.16 | 0.24 | " |
| 111 | " | ST-2 | 20% | 1.16 | 0.16 | 0.22 | " |
| 112 | " | " | 50% | 1.08 | 0.15 | 0.20 | " |
| 113 | " | " | 100% | 0.92 | 0.14 | 0.19 | " |
| 114 | " | ST-4 | 50% | 1.06 | 0.15 | 0.21 | " |
| 115 | " | ST-30 | " | 1.10 | 0.16 | 0.22 | " |
| 116 | " | ST-51 | " | 1.03 | 0.15 | 0.21 | " |
| 117 | " | ST-56 | " | 1.07 | 0.16 | 0.21 | " |
| 118 | M-1 | — | — | 2.18 | 0.17 | 0.29 | " |
| 119 | " | ST-2 | 50% | 2.02 | 0.16 | 0.23 | " |
| 120 | " | ST-30 | " | 2.11 | 0.15 | 0.21 | " |
| 121 | " | ST-51 | " | 2.09 | 0.16 | 0.22 | " |
| 122 | (3) | — | — | 2.27 | 0.15 | 0.26 | — |
| 123 | (3) | ST-2 | 20% | 2.25 | 0.14 | 0.19 | Present Invention |
| 124 | " | " | 50% | 2.24 | 0.13 | 0.15 | Present Invention |
| 125 | " | " | 100% | 2.24 | 0.12 | 0.13 | Present Invention |
| 126 | " | ST-4 | 50% | 2.21 | 0.13 | 0.15 | Present Invention |
| 127 | " | ST-10 | " | 2.26 | 0.14 | 0.16 | Present Invention |
| 128 | " | ST-30 | 20% | 2.28 | 0.15 | 0.20 | Present Invention |
| 129 | " | " | 50% | 2.26 | 0.13 | 0.15 | Present Invention |
| 130 | " | " | 100% | 2.22 | 0.12 | 0.14 | Present Invention |
| 131 | " | ST-38 | 50% | 2.19 | 0.14 | 0.17 | Present Invention |
| 132 | " | ST-40 | " | 2.21 | 0.14 | 0.16 | Present |

TABLE A-continued

| Specimen No. | Coupler | Additive of the present invention Kind | Amount | Maximum color density Dmax | Fog density Dmin Fr | 60° C., 70%, 3d | Remarks |
|---|---|---|---|---|---|---|---|
| 133 | " | ST-45 | " | 2.25 | 0.13 | 0.16 | Invention Present |
| 134 | " | ST-49 | " | 2.21 | 0.14 | 0.17 | Invention Present |
| 135 | " | ST-51 | 20% | 2.26 | 0.14 | 0.19 | Invention Present |
| 136 | " | " | 50% | 2.24 | 0.13 | 0.15 | Invention Present |
| 137 | " | " | 100% | 2.25 | 0.12 | 0.13 | Invention Present |
| 138 | " | ST-56 | 50% | 2.20 | 0.13 | 0.15 | Invention Present |
| 139 | " | ST-62 | " | 2.21 | 0.14 | 0.16 | Invention Present |
| 140 | " | ST-2<br>ST-51 | 25%<br>25% | 2.24 | 0.12 | 0.14 | Invention Present |
| 141 | " | ST-2<br>ST-51 | 50%<br>50% | 2.23 | 0.11 | 0.12 | Invention Present |
| 142 | " | ST-30<br>ST-51 | 25%<br>25% | 2.19 | 0.13 | 0.15 | Invention Present |
| 143 | (39) | — | — | 2.17 | 0.13 | 0.17 | Comparative |
| 144 | " | ST-2 | 50% | 2.15 | 0.11 | 0.12 | Invention Present |
| 145 | (39) | ST-4 | 50% | 2.16 | 0.11 | 0.12 | Invention Present |
| 146 | " | ST-10 | " | 2.13 | 0.12 | 0.14 | Invention Present |
| 147 | " | ST-30 | " | 2.15 | 0.11 | 0.13 | Invention Present |
| 148 | " | ST-38 | " | 2.17 | 0.12 | 0.14 | Invention Present |
| 149 | " | ST-40 | " | 2.16 | 0.12 | 0.14 | Invention Present |
| 150 | " | ST-45 | " | 2.14 | 0.12 | 0.13 | Invention Present |
| 151 | " | ST-49 | " | 2.14 | 0.12 | 0.14 | Invention Present |
| 152 | " | ST-51 | " | 2.17 | 0.11 | 0.12 | Invention Present |
| 153 | " | ST-56 | " | 2.16 | 0.11 | 0.12 | Invention Present |
| 154 | " | ST-62 | " | 2.11 | 0.12 | 0.14 | Invention Present |
| 155 | (15) | — | — | 2.21 | 0.18 | 0.37 | Comparative |
| 156 | " | ST-2 | 50% | 2.19 | 0.14 | 0.18 | Invention Present |
| 157 | " | ST-4 | " | 2.16 | 0.16 | 0.19 | Invention Present |
| 158 | " | ST-30 | " | 2.17 | 0.15 | 0.18 | Invention Present |
| 159 | " | ST-51 | " | 2.18 | 0.14 | 0.17 | Invention Present |
| 160 | " | ST-56 | " | 2.16 | 0.15 | 0.19 | Invention Present |
| 161 | (4) | — | — | 1.88 | 0.16 | 0.24 | Comparative |
| 162 | " | ST-2 | 50% | 1.84 | 0.12 | 0.14 | Invention Present |
| 163 | (34) | — | — | 1.94 | 0.14 | 0.19 | Comparative |
| 164 | " | ST-2<br>ST-51 | 50%<br>25% | 1.91 | 0.11 | 0.13 | Invention Present |

The results in Table A show that the couplers of the present invention exhibit a higher color density than the comparative couplers ExC, R-1 and R-2. It was visually confirmed that with respect to the hue of dyes thus formed, all the couplers of the present invention exhibit a clear hue with little turbidity as compared with the comparative coupler ExC.

Both the comparative couplers R-1 and R-2 exhibit a low color density. The addition of the additives of the present invention tends to further lower the color density of these comparative couplers undesirably. The comparative specimens free of the additives of the present invention exhibit little improvement in the inhibition of stain shortly after processing and a slight improvement in the inhibition of stain with time during storage at 60° C. and 70% RH.

The magenta-coloring pyrrolotriazole coupler (M-1) does not exhibit too great an improvement in the inhibition of stain shortly after processing and with time during storage at 60° C. and 70% RH, either.

On the other hand, although the cyan coupler of the present invention exhibits a high color density, it is disadvantageous in that it gives much stain (particularly stain with time during storage at 60° C. and 70% RH) when used alone.

The results in Table A show that when used in combination with the additives of the present invention, the cyan coupler of the present invention exhibits little drop in the color density as compared with the comparative couplers R-2 and R-3. It was also shown that when used in combination with the additives of the present invention, the cyan coupler of the present invention exhibits a remarkably great improvement in the inhibition of stain shortly after processing and with time during storage at 60° C. and 70% RH as compared with the comparative couplers R-2 and R-3. This demonstrates that the additives of the present invention are extremely effective for pyrrolotriazole cyan couplers.

EXAMPLE 2

Specimens were prepared in the same manner as Specimens 101, 102, 104, 110, 112, 122, 124, 155 and 156 of Example 1 except that the yellow coupler (ExY) was replaced by the yellow couplers ExY-1 and ExY-2 shown below. These specimens were then evaluated in the same manner as in Example 1. The coated amount of the yellow couplers and silver halide were each 80 mole % of that in Example 1.

ExY-1

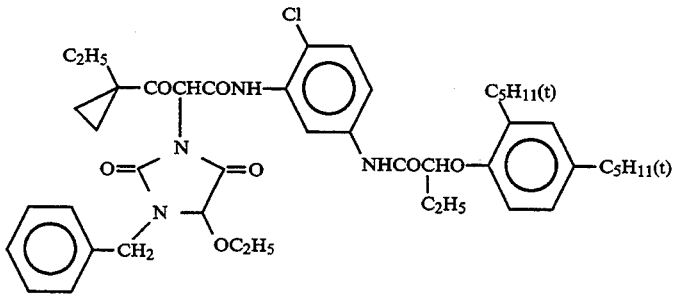

ExY-2

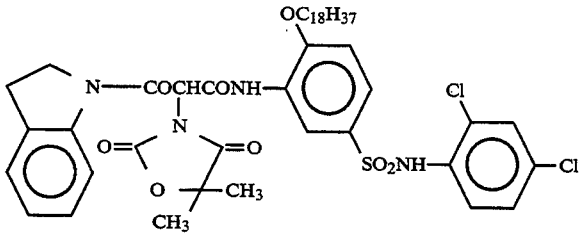

The results were similar to that of Example 1.

EXAMPLE 3

Specimens were prepared in the same manner as in Example 1 of JP-A-3-213853 except that Ex-2 to be incorporated in the 3rd layer, 4th layer and 5th layer in the multi-layer color light-sensitive material specimen 101 was replaced by the cyan couplers (3), (15), (39), (16) and (20) of the present invention and the lipophilic compounds ST-2, ST-7, ST-14 and ST-47 of the present invention were each added to the system in an amount of 25% by weight based on the weight of the coupler. These specimens were then subjected to Processing No. 1-6 in Example 1 of JP-A-3-213853.

These specimens were measured for density with red light to obtain a sensitometry curve from which the fog density was then read. These specimens were then stored at 60° C. and 70% RH for 2 days. These specimens were measured for fog density in the red light range.

In this case, too, the couplers of the present invention exhibit a drop in Dmin when used in combination with the additives of the present invention as in Example 1.

Further, specimens were prepared in the same manner as in Example 1 of JP-A-3-213853 except that Ex-8 and Ex-9 to be incorporated in the 11th, 12th layer and 13th layer were replaced by ExY-3 and ExY-4 shown below in the equimolecular amount, respectively. These specimens were similarly evaluated. As a result, it was confirmed that the same effects can be obtained.

ExY-3

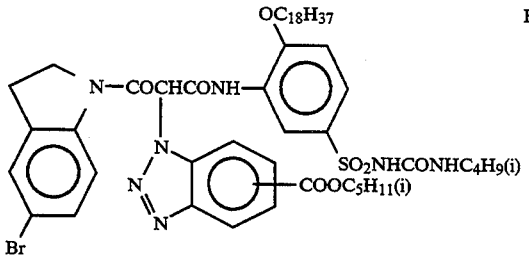

ExY-4

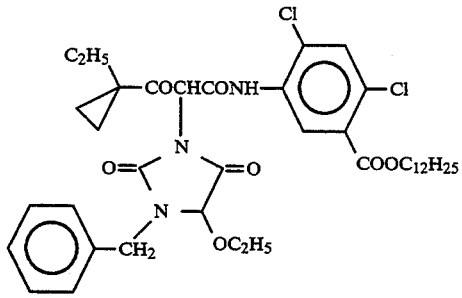

EXAMPLE 4

Specimens were prepared in the same manner as in Example 1 of JP-A-2-854 except that the cyan couplers C-1, C-2, C-6 and C-8 to be incorporated in the 3rd layer, 4th layer and 5th layer in Specimen 101 prepared therein were replaced by the cyan coupler shown in the present Example 2 in the equimolecular amount and the lipophilic compound shown in the present Example 1 was added to the system in an amount of 33.3% by weight based on the weight of coupler. These specimens were then processed in accordance with the method described in JP-A-2-854.

These specimens were then evaluated for discoloration in the same manner as in the present Example 1. In this case, too, substantially the same results as that of Example 1 were obtained.

EXAMPLE 5

Specimens were prepared in the same manner as the color photographic light-sensitive material in Example 2 of JP-A-1-158431 except that ExC-1 or ExC-2 to be incorporated in the 3rd or 4th layer was replaced by the couplers (1), (2), (34), (36), (15), (19) or (48) of the present invention in the equimolecular amount and the present compound ST-1, ST-7, ST-10, ST-14, ST-16, ST-21, ST-24, ST-26, ST-29, ST-32, ST-34, ST-36, ST-37, ST-41, ST-46, ST-47, ST-50, ST-51, ST-57, ST-60, ST-63 or ST-64 was incorporated in the 3rd layer and 4th layer in an amount of 50 mole % per mole of the coupler.

Further, Specimens were prepared in the same manner as the above mentioned specimens except that the magenta coupler ExM-1 or ExM-2 to be incorporated in the 6th layer or 7th layer was replaced by ExM-3 shown below in an equimolecular amount and the yellow coupler ExY-1 to be incorporated in the 11th layer or 12th layer was replaced by ExY-5 shown below in an equimolecular amount.

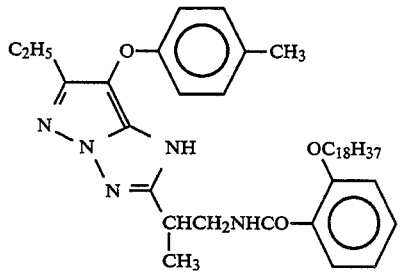

ExM-3

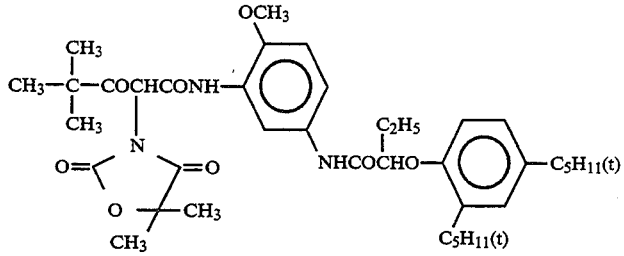

ExY-5

These specimens were exposed to light, and then developed in the same manner as in Example 2 of JP-A-1-158431, and then evaluated for cyan stain in the same manner as in the present Example 1. As a result, it was shown that the combinations according to the present invention exhibit substantially no cyan stain. This demonstrates that the compounds of the present invention exert excellent effects also in this light-sensitive material system.

As mentioned above, silver halide color photographic materials comprising a combination of a pyrrolotriazole cyan coupler of the present invention represented by the general formulae (I) or (II) and compounds of the present invention represented by the general formulae (A) to (D) exhibit reduced cyan fog and cyan stain with time and an excellent fastness of color image.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising on a support at least one silver halide emulsion layer, wherein said at least one silver halide emulsion layer comprises at least one cyan coupler represented by formula (I-a) or (II-a), and at least one lipophilic compound represented by formula (A), (B) or (C) which chemically bonds to an aromatic primary amine color developing agent at a pH of 8 or less to form a substantially colorless product and/or at least one lipophilic compound represented by formula (D) which chemically bonds to an oxidation product of an aromatic primary amine color developing agent at a pH of 8 or less to form a substantially colorless produce:

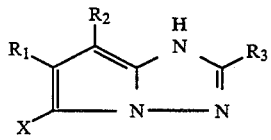

(I-a)

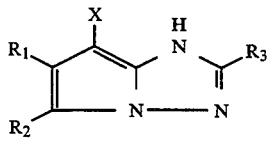

(II-a)

wherein $R_1$ and $R_2$ each represents an electrophilic group whose Hammett's substituent constant $\sigma_p$ is 0.20 or more, with the proviso that the sum of $\sigma_p$ of $R_1$ and $R_2$ is 0.65 or more; $R_3$ represents a hydrogen atom or a substituent; X represents a hydrogen atom or a group which can be eliminated upon a coupling reaction with an oxidation product of an aromatic primary amine color developing agent; and $R_1$, $R_2$, $R_3$ or X may be a divalent group which is bonded to a dimer or higher polymer or high molecular chain to form a single polymer or copolymer;

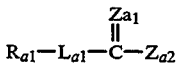

(A)

wherein $L_{a1}$ represents a single bond, —O—, —S—, —CO— or —N($R_{a2}$)—; $R_{a1}$ and $R_{a2}$ are the same or different and each represents an aliphatic group, an aromatic group or a heterocyclic group; $R_{a2}$ also represents a hydrogen atom, an acyl group, a sulfonyl group, a carbamoyl group or a sulfamoyl group; $Z_{a1}$ represents an oxygen atom or a sulfur atom; $Z_{a2}$ represents a hydrogen atom, —O—$R_{a3}$, —S—$R_{a4}$, —$L_{a2}$—C(=$Z_{a1}$')$R_{a5}$ or a heterocyclic group bonded to the rest of the compound via a nitrogen atom; $R_{a3}$ and $R_{a4}$ are the same or different and each represents a vinyl group, an aromatic group or a heterocyclic group which may contain substituents; $L_{a2}$ represents —O— or —S—; $Z_{a1}$' has the same meaning as $Z_{a1}$; $R_{a5}$ represents an aliphatic group, an aromatic group or a heterocyclic group; and at least two of $R_{a1}$, $R_{a2}$ and $Z_{a2}$ may be connected to each other to form a 5- to 7-membered ring;

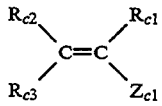

(B)

wherein $R_{b1}$ represents an aliphatic group; and $Z_{b1}$ represents a halogen atom;

(C)

wherein $Z_{c1}$ represents a cyano group, an acyl group, a formyl group, an aliphatic oxycarbonyl group, an aromatic oxycarbonyl group, a carbamoyl group, a sulfamoyl group or a sulfonyl group; $R_{c1}$, $R_{c2}$ and $R_{c3}$ are the same or different and each represents a hydrogen atom, an aliphatic group, an aromatic group, a heterocyclic group or $Z_{c1}$; and at least two of $R_{c1}$, $R_{c2}$, $R_{c3}$ and $Z_{c1}$ may be connected to each other to form a 5- to 7-membered ring;

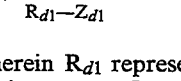

(D)

wherein $R_{d1}$ represents an aliphatic group or an aromatic group; $Z_{d1}$ represents a mercapto group or —$SO_2Y$; and Y represents a hydrogen atom, or an atom or atom group which forms an inorganic or organic sale, —NHN=C($R_{d2}$)$R_{d3}$, —N($R_{d4}$)—N($R_{d5}$)—$SO_2R_{d6}$, —N($R_{d7}$)—N($R_{d8}$)—$COR_{d9}$ or —C($R_{d10}$)($OR_{d11}$)—$COR_{d12}$ in which $R_{d2}$ and $R_{d3}$ are the same or different and each represents a hydrogen atom, an aliphatic group, an aromatic group or a heterocyclic group, $R_{d2}$ and $R_{d3}$ may be connected to each other to form a 5- to 7-membered ring, $R_{d4}$, $R_{d5}$, $R_{d7}$ and $R_{d8}$ are the same or different and each represents a hydrogen atom, an aliphatic group, an aromatic group, a heterocyclic group, an acyl group, an aliphatic oxycarbonyl group, a sulfonyl group, a ureide group or a urethane group, with the proviso that at least one of $R_{d4}$ and $R_{d5}$ and at least one of $R_{d7}$ and $R_{d8}$ are hydrogen atoms, $R_{d6}$ and $R_{d9}$ each represents a hydrogen atom, an aliphatic group, an aromatic group or a heterocyclic group, $R_{d6}$ also represents an aliphatic amino group, an aromatic amino group, an aliphatic oxy group, an aromatic oxy group, an acyl group, an aliphatic oxycarbonyl group or an aromatic oxycarbonyl group, at least two of $R_{d4}$, $R_{d5}$ and $R_{d6}$ may be connected to each other to form a 5- to 7-membered ring, at least two of $R_{d7}$, $R_{d8}$ and $R_{d9}$ may be connected to each other to form a 5- to 7-membered ring, $R_{d10}$ represents a hydrogen atom, an aliphatic group, a aromatic group, a halogen atom, an acyloxy group or an sulfonyl group, $R_{d11}$ represents a hydrogen atom or a hydrolyzable group, and $R_{d12}$ represents a hydrogen atom, an aliphatic group, an aromatic group or a heterocyclic group.

2. The silver halide color photographic material as in claim 1, wherein $R_3$ represents a hydrogen atom, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyl oxy group, a silyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic material as in claim 2, wherein $R_3$ is an alkyl group or an aryl group.

4. The silver halide color photographic material as in claim 1, wherein $R_1$ and $R_2$ each represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanato group, a thiocarbonyl group, a halogenated alkyl group, a halogenated alkoxy group, a halogenated aryloxy group, a halogenated alkylamino group, a halogenated alkylthio group, an aryl group substituted by at least one other electrophilic group having a up value of at least 0.20, a heterocyclic group, a halogen atom, an azo group, or a selenocyanato group.

5. The silver halide color photographic material as in claim 4, wherein $R_1$ and $R_2$ each represents an alkoxycarbonyl group, a nitro group, a cyano group, an arylsulfonyl group, a carbamoyl group, a halogenated alkyl group, or an aryloxycarbonyl group.

6. The silver halide color photographic material as in claim 5, wherein $R_1$ is a cyano group and $R_2$ is a branched alkoxycarbonyl group.

7. The silver halide color photographic material as in claim 1, wherein X represents a hydrogen atom, a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkylthio group, an arylthio group, a heterocyclic thio group, a carbamoylamino group, a five-membered or six-membered nitrogen containing heterocyclic group, an imido group, or an arylazo group.

8. The silver halide color photographic material as in claim 7, wherein X is a halogen atom, an alkylthio group, or an arylthio group.

9. The silver halide color photographic material as in claim 1, wherein the cyan coupler is represented by the formula (I-a).

10. The silver halide color photographic material as in claim 1, wherein the cyan coupler is contained in an amount of from $1\times10^{-3}$ to 1 mole per mole of silver halide.

11. The silver halide color photographic material as in claim 1, wherein said at least one silver halide emulsion layer comprising a cyan coupler and a lipophilic compound is a red-sensitive silver halide emulsion layer.

12. The silver halide color photographic material as in claim 1, wherein the lipophilic compound of formula (A) is a compound represented by formula (A-I), (A-II), (A-III), (A-IV), or (A-V):

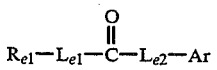
(A-I)

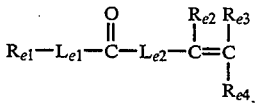
(A-II)

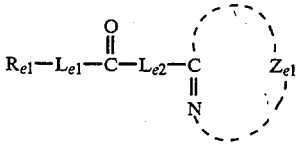
(A-III)

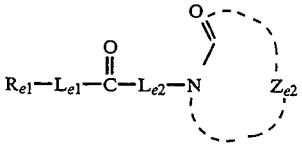
(A-IV)

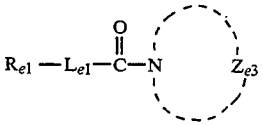
(A-V)

wherein $R_{e1}$ has the same meaning as $R_{a1}$ in formula (A), $L_{e1}$ represents a single bond or —O—, $L_{e2}$ represents —O—or —S—, Ar represents an aromatic group, $R_{e2}$ to $R_{e4}$ are the same or different and each represents a hydrogen atom, an aliphatic group, an aromatic group, a heterocyclic group, an aliphatic oxy group, an aromatic oxy group, a heterocyclic oxy group, an aliphatic thio group, an aromatic thio group, a heterocyclic thio group, an amino group, an aliphatic amino group, an aromatic amino group, a heterocyclic amino group, an acyl group, an amide group, a sulfonamide group, a sulfonyl group, an aliphatic oxycarbonyl group, an aromatic oxycarbonyl group, a sulfo group, a carboxyl group, a formyl group, a hydroxyl group, an acyloxy group, a ureide group, a urethane group, a carbamoyl group or a sulfamoyl group, at least two of $R_{e2}$ to $R_{e4}$ may be connected to each other to form a 5- to 7-membered ring, $Z_{e1}$ and $Z_{e1}$ each represents a nonmetallic atom group required for the formation of a 5- to 7-membered ring, and $Z_{e1}$ represents a nonmetallic atom group required for the formation of a 5- to 7-membered aromatic ring.

13. The silver halide color photographic material as in claim 12, wherein the lipophilic compound of formula (A) is a compound represented by formula (A-I) or (A-III).

14. The silver halide color photographic material as in claim 1, wherein $R_{d1}$ is an aromatic group.

15. The silver halide color photographic material as in claim 1, wherein $Z_{d1}$ is $—SO_2Y$ in which Y is a hydrogen atom or an atom or atom group which forms an inorganic or organic salt, and $R_{d1}$ is a phenyl group containing a substituent whose total Hammett's $\sigma$ value with respect to the $—SO_2Y$ is 0.5 or more.

16. The silver halide color photographic material as in claim 1, wherein the lipophilic compound of formulae (A) to (D) is contained in an amount of 0.5 to 300 mol % per mol of the coupler of formulae (I-a) and (II-a).

* * * * *